US008464735B2

(12) United States Patent
Studebaker

(10) Patent No.: US 8,464,735 B2
(45) Date of Patent: Jun. 18, 2013

(54) SPRAYLESS SURFACE CLEANING WAND

(76) Inventor: Roy Studebaker, Centralia, WA (US)

( * ) Notice: Subject to any disclaimer, the term of this patent is extended or adjusted under 35 U.S.C. 154(b) by 1157 days.

(21) Appl. No.: 12/378,663

(22) Filed: Feb. 17, 2009

(65) Prior Publication Data

US 2010/0206344 A1 Aug. 19, 2010

(51) Int. Cl.
*A47L 9/02* (2006.01)

(52) U.S. Cl.
USPC ..... 134/103.2; 15/322

(58) Field of Classification Search
USPC ..... 134/103.2
See application file for complete search history.

(56) References Cited

U.S. PATENT DOCUMENTS

| | | | | |
|---|---|---|---|---|
| 3,696,689 | A | 10/1972 | Senter et al. | |
| 3,841,910 | A | 10/1974 | Baker | |
| 3,964,449 | A | 6/1976 | Thien et al. | |
| 3,995,603 | A | 12/1976 | Thien et al. | |
| 4,095,309 | A | 6/1978 | Sundheim | |
| 4,137,600 | A | 2/1979 | Albishausen | |
| 4,161,802 | A | 7/1979 | Knight et al. | |
| 4,227,893 | A | 10/1980 | Shaddock | |
| 4,335,486 | A | 6/1982 | Kochte | |
| 4,441,229 | A | 4/1984 | Monson | |
| 4,488,330 | A * | 12/1984 | Grave | 15/322 |
| 4,534,746 | A | 8/1985 | Hausinger | |
| 4,649,594 | A | 3/1987 | Grave | |
| 4,692,053 | A | 9/1987 | Sampedro | |
| 4,862,551 | A | 9/1989 | Martinez et al. | |
| 5,116,425 | A | 5/1992 | Ruef | |
| 5,157,805 | A | 10/1992 | Pinter | |
| 5,165,139 | A | 11/1992 | Oxman | |
| 5,218,737 | A | 6/1993 | Dansby et al. | |
| 5,371,918 | A | 12/1994 | Shero | |
| 5,430,910 | A | 7/1995 | Wiley | |
| 5,561,884 | A | 10/1996 | Nijland et al. | |
| 5,596,788 | A | 1/1997 | Linville et al. | |
| 5,613,271 | A | 3/1997 | Thomas | |
| 5,815,869 | A | 10/1998 | Hopkins | |
| 5,950,273 | A | 9/1999 | Suhaka et al. | |
| 6,151,748 | A | 11/2000 | Earhart, Jr. et al. | |
| 6,243,914 | B1 * | 6/2001 | Studebaker | 15/322 |
| 6,266,892 | B1 | 7/2001 | Haynie | |
| 6,298,577 | B1 | 10/2001 | Haynie | |
| 6,981,338 | B2 | 1/2006 | Jensen et al. | |
| 7,070,662 | B2 | 7/2006 | Studebaker | |

FOREIGN PATENT DOCUMENTS

| | | |
|---|---|---|
| FR | 002601239 A | 1/1988 |
| JP | 1256920 | 10/1989 |
| JP | 4261629 | 9/1992 |
| WO | WO 9935953 | 7/1999 |

* cited by examiner

*Primary Examiner* — Michael Barr
*Assistant Examiner* — Jason Riggleman
(74) *Attorney, Agent, or Firm* — Charles J. Rupnick Attorney at Law

(57) ABSTRACT

An elongated solution injection bar operable in a cleaning system as a combination dry vacuum and fluid carpet cleaner. The elongated solution injection bar having an upper solution distribution and pressure equalization chamber in fluid communication with a lower solution discharge chamber through a solution flow restrictor structured for distributing hot liquid cleaning solution in a substantially uniform flow along substantially the entire length of a cleaning head operating surface. The hot liquid cleaning solution being discharged from the lower solution discharge chamber at a volumetric flow rate of or about 1 gallon per minute (gpm) or less, so that the liquid cleaning solution is discharged to the operating surface as a flood under pressure.

21 Claims, 9 Drawing Sheets

SPRAYLESS SURFACE CLEANING WAND

FIELD OF THE INVENTION

The present invention to a tool for cleaning surfaces, and in particular to an apparatus and method of delivering cleaning fluid for cleaning carpet and other flooring surfaces, wall surfaces and upholstery.

BACKGROUND OF THE INVENTION

Many apparatuses and methods are known for cleaning carpeting and other flooring, wall and upholstery surfaces. The cleaning apparatuses and methods most commonly used today apply cleaning fluid as a spray under pressure to the surface whereupon the cleaning fluid dissolves the dirt and stains and the apparatus scrubs the fibers while simultaneously applying a vacuum or negative pressure to extract the cleaning fluid and the dissolved soil. Although such relatively high pressure methods are the most commonly used, they have disadvantages. First, the majority of the soil is at or near the surface of the fibers so that high pressure cleaning tends to drive some of the surface soil and cleaning fluid deeper, whereby a very powerful vacuum system is required to extract particles that have been driven beneath the outermost surface. Furthermore, the use of cleaning fluid under pressure, applied as a spray through conventional jets, drives the fluid itself deeper, and the fluid that is not immediately removed by the vacuum source requires a significantly longer drying period. While longer drying time is an inconvenience, if the carpeting is used prior to its being completely dry, it is more likely to become soiled. Additionally, conventional jets atomize the sprayed fluid which then comes into contact with the air, causing significant heat loss and diminishing the cleaning power of the fluid.

Many different apparatuses and methods for spraying cleaning fluid under pressure and then removing it with a vacuum are illustrated in the prior art supplied herewith but will not be discussed in detail.

Another category of carpeting and upholstery cleaning apparatuses and methods use a rotating device wherein the entire machine is transported over the carpeting while a cleaning head is rotated about a vertical axis. Typically, these machines include a plurality of arms, each of having one or more spray nozzles or a vacuum source providing a more intense scrubbing action since, in general, more scrubbing surfaces contact the carpet. These apparatuses and methods are primarily illustrated in U.S. Pat. No. 4,441,229 granted to Monson on Apr. 10, 1984, and are listed in the prior art known to the inventor but not discussed in detail herein.

A third category of carpeting and upholstery cleaning apparatuses and methods that attempt to deflect or otherwise control the cleaning fluid are illustrated by U.S. Pat. No. 4,137,600 granted to Albishausen on Feb. 6, 1970, which discloses a cleaning apparatus wherein the cleaning fluid is changed into a liquid curtain by a baffle within the cleaning head; U.S. Pat. No. 4,335,486 granted to Kochte on Jan. 22, 1982, which discloses a surface cleaning machine wherein the cleaning fluid is deposited upon the surface of the carpet pile from a wick like device wetted with the cleaning fluid; U.S. Pat. No. 4,649,594 granted to Grave on Mar. 17, 1987, which discloses a cleaning head wherein the cleaning solution is sprayed through a narrow passage and some is wicked along the surface of the passage; U.S. Pat. No. 5,157,805 granted to Pinter on Oct. 27, 1992, which discloses a method and apparatus for cleaning a carpet wherein the cleaning fluid is sprayed by nozzle against the back of a striker plate and then flows downwardly and through the carpet to a pickup vacuum; and U.S. Pat. No. 5,561,884 granted to Nijland et al on Oct. 8, 1996, which discloses a suction attachment spray member wherein the fluid is sprayed against a distributor plate that creates a planar diverging liquid jet substantially filling the vacuum chamber.

U.S. Pat. No. 6,243,914, which was granted Jun. 12, 2001, to the inventor of the present patent application and which is incorporated herein by reference, discloses a cleaning head for carpets, walls or upholstery, having a rigid open-bottomed main body that defines a surface subjected to the cleaning process. Mounted within or adjacent to the main body and coplanar with the bottom thereof is a fluid-applying device which includes a slot at an acute angle to the plane of the bottom of the body located adjacent the plane of the bottom of the body, the slot configured such that the fluid is applied in a thin sheet that flows out of the slot and into the upper portion of the surface to be cleaned and subsequently into the vacuum source for recovery. The cleaning head is alternatively multiply embodied in a plurality of arms which are rotated about a hub.

FIG. 1 is a cross-sectional view that illustrates one of four separate embodiments of the cleaning head disclosed in U.S. Pat. No. 6,243,914 wherein the cleaning head 1 for applying cleaning fluid without the inherent problems of spray either escaping or unduly penetrating the carpeting. Front and back surfaces 3, 5 of the cleaning head 1 combine with opposing end panels (not shown) to define a rectangular lip 7 which defines a surface contact area of the surface to be cleaned, which is momentarily subjected to the cleaning environment generated by the cleaning head 1. Securely mounted to an interior portion of the cleaning head 1 is a downwardly open fluid supply chamber 9 formed between a first wall 11 terminating in a head surface 13 and a second wall 15 terminating in an inwardly turned foot 17. The fluid supply chamber 9 terminates in an angled slot or groove 19 adjacent to the head surface 13 and oriented at an obtuse angle thereto, i.e., an acute angle to the surface to be cleaned. Walls 21 and 23 combine with opposing end panels (not shown) to form a vacuum chamber 25 that is spaced away from the fluid supply chamber 9 by the width of the head surface 13.

As disclosed in U.S. Pat. No. 6,243,914, cleaning fluid is supplied in a steady stream downwardly through the fluid supply chamber 9 between the walls 11 and 15 and flows outwardly through the angled slot 19 past the foot 17 and is drawn in a sheet across the head surface 13 by a vacuum formed in the vacuum chamber 25, whereby it is applied uniformly to the carpeting or other surface to be cleaned. The fluid is removed from the cleaned surface by vacuum in the vacuum chamber 25. The utilization of a sheet of fluid which flows down the fluid supply chamber 9 and across the head surface 13 eliminates the cooling of the fluid that results from atomizing caused by prior art spray nozzles. The utilization of a sheet of fluid also reduces the amount of fluid being used for a given cleaning job, and eliminates over spray of the cleaning fluid should the cleaning head 1 be inadvertently moved from the surface to be cleaned or tilted so one edge is raised.

However, it is generally understood in the art that improvements are needed in reducing the quantity of cleaning fluid driven by the cleaning apparatus beneath the outermost surface and the residual cleaning fluid left on the outermost surface by the cleaning head is desirable.

U.S. Pat. No. 7,070,662, which was granted Jul. 4, 2006, to the inventor of the present patent application and which is incorporated herein by reference, discloses improvements to the cleaning head disclosed in U.S. Pat. No. 6,243,914. According to U.S. Pat. No. 7,070,662 a bar jet assembly which improves the functioning of the cleaning head by reducing the residual cleaning fluid left on the outermost surface by the cleaning head.

Furthermore, it is generally understood in the art that uniform application of cleaning fluid to the surface is critical for ensuring uniform cleaning in a single pass. Such uniform application of cleaning fluid is not important given the cleaning head disclosed in U.S. Pat. No. 6,243,914 and the bar jet assembly improvements disclosed in U.S. Pat. No. 7,070,662 are utilized in combination with a rotary cleaning plate that is coupled for high speed rotary motion.

As illustrated in FIG. 2, the cleaning head disclosed in U.S. Pat. No. 7,070,662, includes a substantially circular rotary cleaning plate 31 having a cleaning fluid distribution manifold 33 including a central sprue hole 35 for receiving the pressurized cleaning fluid and an expansion chamber 37 for reducing the pressure of the cleaning fluid to below a delivery pressure provided by a source of pressurized cleaning fluid. Expansion chamber 37 is connected for distributing the liquid cleaning fluid outward along closed liquid cleaning fluid distribution channels 39 to application by a plurality of bar jet assemblies 41 uniformly distributed across the bottom cleaning surface of the rotary cleaning plate 31. Each of the bar jet assemblies 41 includes a cleaning fluid discharge slot or groove 43 adjacent to a fluid retrieval slot 45 coupled to a vacuum source for retrieving a quantity of soiled cleaning fluid.

As indicated by the rotational arrow in FIG. 2, the rotary cleaning plate 31 is rotated at high speed during application of cleaning fluid to the target surface. The rotary cleaning plate 31 successfully delivers a generally uniform distribution of cleaning fluid to a target surface between the quantity of bar jet assemblies 41 and the large number of passes of each bar jet assembly 41 occasioned by the high speed rotary motion of the cleaning plate 31 regardless of any lack of uniformity in the instantaneous fluid delivery of any individual bar jet assembly 41. Additionally, the instantaneous fluid delivery of each individual bar jet assembly 41 tends to be generally uniform at least because the length of the bar jet is minimal as compared with the size of the rotary cleaning plate 31.

However, it is generally understood that, by the laws of hydrodynamics, it is generally difficult to provide a uniform distribution of pressurized cleaning fluid along a discharge slot or groove of an extended length.

SUMMARY OF THE INVENTION

The present invention overcomes limitations of the prior art by providing a novel cleaning head apparatus and method for spraylessly delivering cleaning fluid for cleaning carpet and other flooring surfaces, wall surfaces and upholstery.

According to one aspect of the present invention is an elongated solution injection bar operable in a cleaning system as a combination dry vacuum and fluid carpet cleaner. The elongated solution injection bar having an upper solution distribution and pressure equalization chamber in fluid communication with a lower solution discharge chamber through a solution flow restrictor structured for distributing hot liquid cleaning solution in a substantially uniform flow along substantially the entire length of a cleaning head operating surface. The hot liquid cleaning solution being discharged from the lower solution discharge chamber at a volumetric flow rate of or about 1 gallon per minute (gpm) or less, so that the liquid cleaning solution is discharged to the operating surface as a flood under pressure.

According to another aspect of the invention, the elongated solution injection bar is combined in a combination dry vacuum and fluid carpet cleaner, including a pair of cleaning solution extraction or retrieval slots formed adjacent to opposite edges of a cleaning head operating surface of the solution injection bar and substantially contiguous therewith. The solution retrieval slots are coupled into a vacuum chamber that communicates with a source of vacuum for extracting from the carpet spent cleaning solution and soil dissolved. The solution retrieval slots are coupled to the source of vacuum through a vacuum wand and associated hose and operated to simultaneously extract spent cleaning solution as the carpet is fluid cleaned.

According to another aspect of the invention, novel cleaning head apparatus optionally includes at least one elongated dry vacuum slot that is sized large enough to receive hair, dirt, gravel and other extraneous large debris. The optional dry vacuum slot also communicates with the vacuum hose which in turn communicates with a main waste receptacle of the carpet cleaning system. By example and without limitation, the dry vacuum slot is positioned either in front or back of the cleaning solution retrieval slots and solution injection bar. If present, the dry vacuum slot is thus positioned either to initially pre-vacuum the carpet before fluid cleaning, whereby the operator is relieved of carrying a conventional dry vacuum machine in addition to the fluid cleaning machine. This positioning also permits operation of the optional dry vacuum slot in combination with the cleaning solution retrieval slots for assisting in more rapidly drying of the carpet to a slightly damp state, whereupon a fan may be used for completing drying.

According to another aspect of the invention, the present invention provides a method for cleaning a surface.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein:

FIGS. 5A-5F illustrate one embodiment of the novel solution injection bar, wherein:

FIG. 5A is a front elevation view of one of a pair of rigid front and back plates forming the solution injection bar, FIG. 5B is a cross section view through the one of the front and back plates shown in FIG. 5A, FIG. 5C is a bottom elevation view of the one of front and back plates shown in FIG. 5A, FIG. 5D is a front elevation view that illustrates the other one of front and back plates that mates with the one of front and back plates shown in FIG. 5A, FIG. 5E is cross section view through the one of front and back plates shown in FIG. 5D, and FIG. 5F is a cross section view through the front and back plates mated in the assembly of the solution injection bar;

FIGS. 6A-6C illustrate alternative embodiments of a cleaning fluid flow restrictor formed between the front and back plates forming the novel solution injection bar, wherein:

FIG. 6A illustrates an alternative of the cleaning solution flow restrictor having flow restriction orifices formed as a plurality of generally rectangular slots in one of the front and back plates, FIG. 6B illustrates another alternative of the cleaning solution flow restrictor having flow restriction orifices formed as a plurality of either V-shaped or generally rectangular discharge grooves formed in each of the front and back plates, and FIG. 6C illustrates another alternative of the cleaning solution flow restrictor having flow restriction orifices formed as a plurality of either V-shaped or generally rectangular discharge slots or grooves formed in each of the front and back plates;

FIGS. 7A-7E illustrate one embodiment of two outer face plates that cooperate with the solution injection bar to form cleaning solution extraction or retrieval slots on the novel cleaning head, wherein:

FIG. 7A is a side view of the outer face plate,

FIG. 7B is a top view of the face plate,

FIG. 7C is a bottom view of the face plate,

FIG. 7D is a cross-section of the face plate, and

FIG. 7E is a cross-section view showing the outer face plates in combination with the solution injection bar and forming the cleaning solution extraction or retrieval slots on the novel cleaning head;

FIGS. 8A-8F illustrate another embodiment of the solution injection bar formed of three cooperating substantially rigid elongated plates, including a middle plate sandwiched between two substantially identical outside plates, wherein:

FIG. 8A is a cross section taken through the solution injection bar assembly showing the elongated upper pressure equalization chamber configured as a single channel feature formed entirely within the middle plate, the cooperating elongated lower solution discharge chamber is configured as a single channel feature formed entirely within the middle plate and space away from the upper channel feature by an elongated bar portion having a plurality of solution discharge notches of the cleaning solution flow restrictor formed therein, FIG. 8B is a side view of the elongated middle plate showing the upper and lower channel features as well as the discharge notches of the solution flow restrictor, FIG. 8C is an bottom view of the elongated middle plate showing the open lower channel feature extending between opposing end portions with the discharge notches of the solution flow restrictor shown by example and without limitation as being formed one face of the middle plate, and optionally on an opposite second face, as well, FIG. 8D is a cross section view of the middle plate showing by example and without limitation a cleaning solution inlet orifice being optionally formed in one of the end portions thereof, FIG. 8E illustrates an interior face of one outside plate being formed with one or more of the cleaning solution inlet orifice and apertures for fasteners for interconnecting the outside plates on opposite sides of the middle plate, and FIG. 8F is a cross section view taken through one outside plate being formed with the substantially planar lower lengthwise edge portion that cooperates with a counterpart of the other outside plate to form the cleaning head operating surface.

DETAILED DESCRIPTION OF PREFERRED EMBODIMENT

Figure 1:
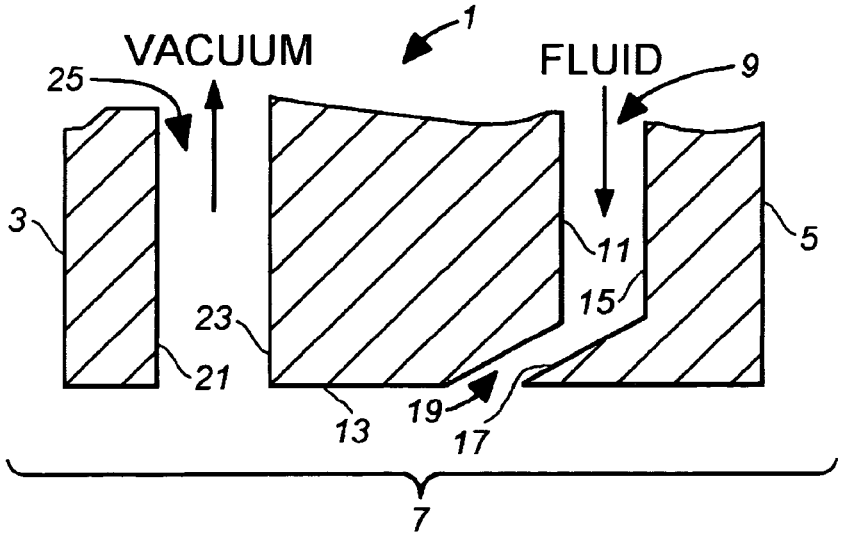
Fig. 1 (Prior Art)
FIG. 1 is a cross-sectional view that illustrates one of four separate embodiments of the cleaning head disclosed in U.S. Pat. No. 6,243,914.
Figure 2:
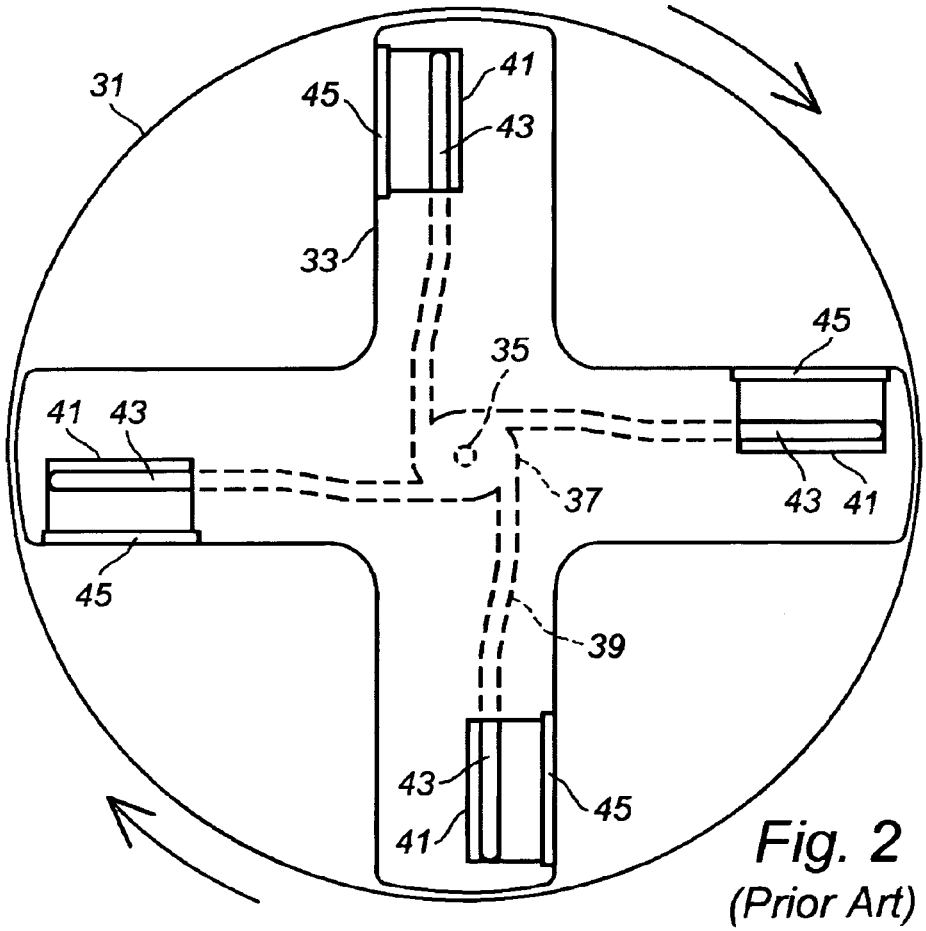
Fig. 2 (Prior Art)
FIG. 2 illustrates one of several embodiments of a bar jet assembly disclosed in U.S. Pat. No. 7,070,662.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

In the Figures, like numerals indicate like elements.

Figure 3:
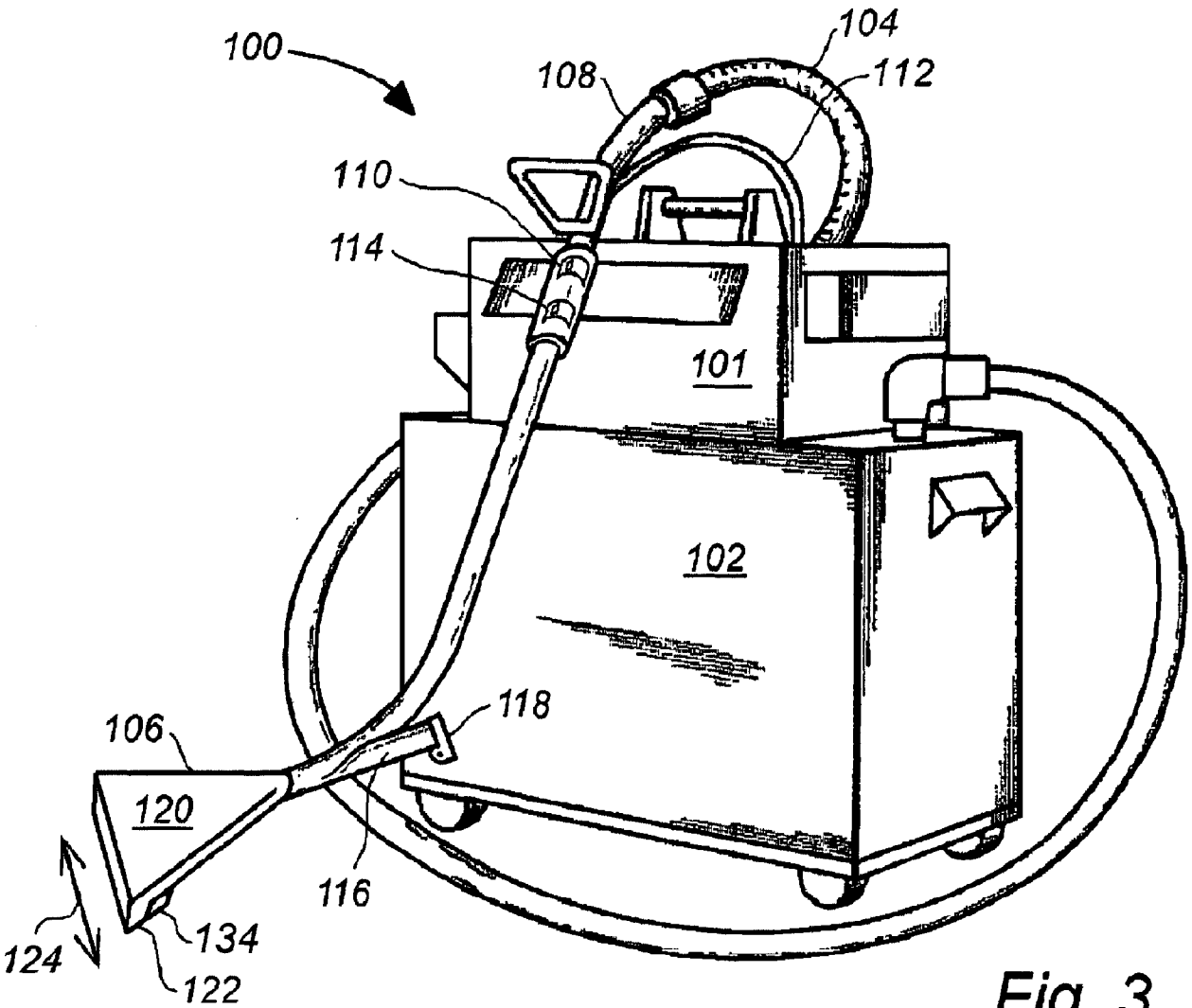
FIG. 3 is an exemplary illustration of a cleaning system useful for operating the novel cleaning head disclosed herein.

FIG. 3 is an exemplary illustration of a cleaning system 100 useful for operating the improved cleaning head of the present invention as a combination dry vacuum and fluid carpet cleaner. The cleaning system 100 is, for example, embodied in a vacuum source and supply of a pressurized hot liquid cleaning solution depicted generally at 101 mounted above a main waste receptacle 102. Soiled cleaning fluid is routed to the main waste receptacle 102 via a vacuum hose 104 interconnected with a cleaning head assembly 106 of the invention through a stainless steel tubular vacuum wand 108, whereby spent cleaning solution and soil dissolved therein are withdrawn under a vacuum force supplied by the machine, as is well known in the art. A vacuum control valve or switch 110 is provided for controlling the vacuum source 101. The pressurized liquid cleaning solution is supplied to the cleaning head 106 via a cleaning solution delivery tube 112 coupled to the source of pressurized liquid cleaning solution. A cleaning solution flow control switch or valve 114 permits switching between the fluid cleaner and dry vacuum processes of the cleaning head 106. It is to be understood that this cleaning system 100 is optionally truck-mounted. According to one embodiment, the vacuum hose 104 optionally includes a lower vacuum connection 116 with a self-sealing cap 118.

The cleaning head assembly 106 includes a body 120 carrying a novel solution injection bar assembly 122 that is elongated to extend substantially an entire width 124 of the cleaning head body 120. The novel solution injection bar 122 of the cleaning head 106 is connected to the supply of pressurized hot liquid cleaning solution 101 via liquid cleaning solution delivery tube 112 which in turn fluidly communicates with the novel solution injection bar 122.

Figure 4:
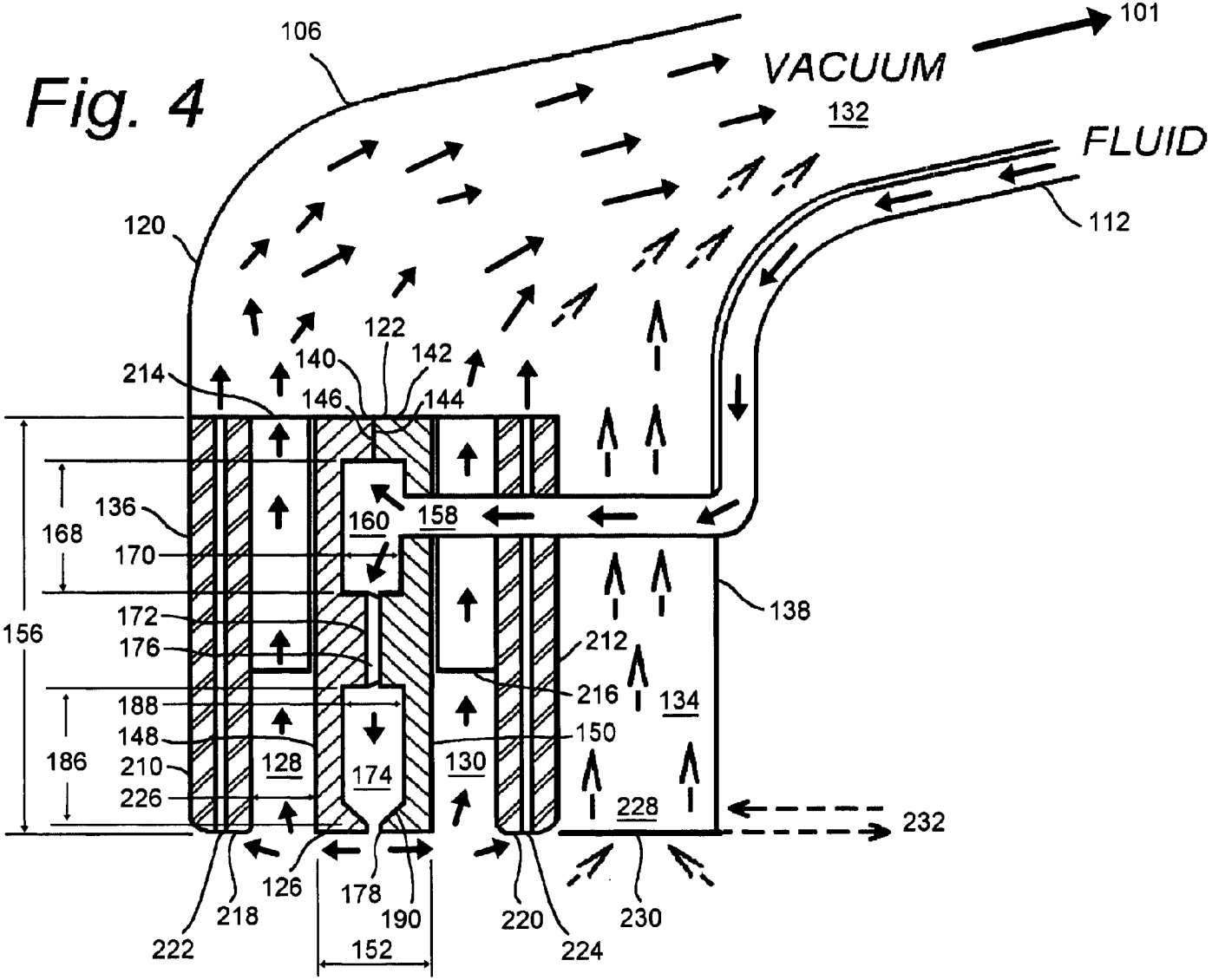
FIG. 4 is a cross-sectional view that illustrates an exemplary schematic of the novel cleaning head assembly taken through the view of FIG. 3.

FIG. 4 is a cross-sectional view that illustrates an exemplary schematic of the cleaning head assembly 106 taken through the view of FIG. 3. An elongated and substantially planar cleaning head operating surface 126 is formed along a lower lengthwise edge of the solution injection bar 122. The elongated planar cleaning head operating surface 126 is the portion of the solution injection bar 122 that will face and contact the carpet or other target surface to be cleaned. A pair of substantially rigid cleaning solution extraction or retrieval slots 128 and 130 formed adjacent to opposite edges of the cleaning head operating surface 126 and substantially contiguous therewith. The cleaning solution retrieval slots 128, 130 are optionally oriented substantially upright (shown) relative to the cleaning head operating surface 126. The solution retrieval slots 128, 130 are coupled into a vacuum chamber 132 that communicates with the vacuum hose 104 for extracting from the carpet spent cleaning solution and soil dissolved therein via a fluid extraction airstream produced by a vacuum formed therein for delivery to the waste receptacle 102. The solution retrieval slots 128, 130 are thus coupled to the source of vacuum 101 through the vacuum hose 104 and operated to dry the carpet as it is fluid cleaned. Vacuum control switch 110 controls the vacuum source 101, as disclosed herein.

The cleaning solution retrieval slots 128, 130 are substantially the same length as the solution injection bar 122 for drawing a thin and substantially uniform sheet of cleaning solution across the cleaning head operating surface 126 so that the spent fluid stays near the surface of the nap and does not penetrate deep into the carpeting. Extracting the spent cleaning solution from the carpet is a function of both vacuum pressure and air flow of the fluid extraction airstream. Vacuum pressure is maximized by keeping the retrieval slots 128, 130 in close contact with the carpet or other target surface to be cleaned, which is accomplished by positioning the retrieval slots 128, 130 substantially coplanar with the operating surface 126, as shown. Air flow is maximized by maximizing the area of the openings into retrieval slots 128, 130 adjacent to operating surface 126. However, too large openings into retrieval slots 128, 130 results in the vacuum pressure of the fluid extraction airstream sucking fabric into the slots 128, 130 and thereby making the cleaning head assembly 106 difficult to move across the carpet or other fabric target. Therefore, the retrieval slots 128, 130, though elongated, are made narrow to minimize the opportunity to pull up the fabric.

The cleaning head assembly 106 is a combination dry vacuum and fluid carpet cleaner. The solution flow control switch or valve 114 permits switching between the fluid cleaner and dry vacuum processes of the cleaning head 106 by stopping flow of the cleaning solution to the solution injection bar 122. The solution flow control 114 is turned ON to allow the cleaning head 106 to be operated in a fluid cleaning mode with a constant flow of liquid cleaning solution to clean the carpet. Optionally, the solution flow control 114 includes a LOW setting for selecting a reduced flow of cleaning solution in the fluid cleaning mode. When the solution flow control 114 is turned OFF to stop flow of the liquid cleaning solution, vacuum is applied to the cleaning solution retrieval slots 128, 130 for applying the fluid extraction airstream to the carpet, whereby the cleaning head 106 is operated in a dry vacuum mode for drying of the carpet to slightly a damp state, whereupon a fan may be used for completing drying.

According to one embodiment, the cleaning head 106 optionally includes one or more dry vacuum slots 134 sized large enough to receive hair, dirt, gravel and other extraneous large debris. The dry vacuum slots 134 also communicate with the vacuum hose 104 which in turn communicates with the main waste receptacle 102 of the cleaning system 100. By example and without limitation, the one or more dry vacuum slots 134 are positioned on either side of the cleaning solution retrieval slots 128, 130 on either the nominal front 136 or back 138 (shown) of the cleaning head 106. The dry vacuum slots 134 are thus positioned either to initially pre-vacuum the carpet before fluid cleaning, or else to operate in combination with the cleaning solution retrieval slots 128, 130 as additional solution retrieval slots for assisting in more rapidly drying of the carpet to the damp state.

The novel solution injection bar 122 is a substantially rigid elongated structure formed of a pair of cooperating substantially rigid mating front and back plates 140 and 142. The front and back plates 140, 142 are formed with respective substantially planar mating interior faces 144 and 146 that come together in the assembly of the rigid solution injection bar 122. When assembled in the assembly of the rigid solution injection bar 122 the rigid front and back plates 140, 142 define a pair of opposing outer walls 148 and 150 spaced apart by a thickness dimension 152. The front and back plates 140, 142 are each formed with a length dimension 154 (shown in one or more subsequent figures) and height dimension 156 with the length dimension 154 being much greater than the height dimension 156, and the height dimension 156 being much greater than the thickness dimension 152. By example and without limitation, the length dimension 154 of the novel solution injection bar 122 is as much as ten to fourteen inches or more when the height dimension 156 is only about one inch and the thickness dimension 152 is only about one quarter inch divided about evenly between the front and back plates 140, 142.

The elongated substantially planar cleaning head operating surface 126 is formed along one lengthwise edge of the solution injection bar 122 and is the portion of the solution injection bar 122 that will face and contact the carpet or other target surface to be cleaned. The cleaning head operating surface 126 is thus in direct physical communication with the fabric when the cleaning system 100 is in operation. The cleaning head operating surface 126 is substantially planar rather than having a tapering or V-shaped cross section because the majority of the soil is at or near the surface of the carpet nap so the pressurized cleaning solution is not intended to penetrate deep into the carpeting. Therefore, the operating surface 126 of the solution injection bar 122 is substantially planar so the cleaning solution is kept near the surface of the nap to speed drying of the carpet. In contrast, some extraction machines for removing liquid from carpet advantageously can have a tapering or V-shaped cross section with a wider upper end and a narrower lower end for penetrating into the carpeted surface and locating vacuum extraction nozzles close to the base of the carpet nap.

A cleaning solution inlet orifice 158 is provided through the wall 148, 150 of one or both of the respective mating front and back plates 140, 142 adjacent to one end of the solution injection bar 122. The cleaning solution inlet orifice 158 is coupled to the source of hot liquid cleaning solution through the cleaning solution delivery tube 112. The cleaning solution inlet orifice 158 in turn communicates with a substantially sealed upper cavity 160 formed within the substantially rigid elongated structure of the solution injection bar 122 between the mating interior faces 144, 146 of respective front and back plates 140, 142. The inlet orifice 158 may be centrally located in the cavity 160, or the inlet orifice 158 may be positioned more nearly adjacent to one end of the cavity 160. By example and without limitation, the cavity 160 is formed by a pair of substantially identical mating upper channels 162 and 164 recessed into the substantially planar interior faces 144, 146 of respective front and back plates 140, 142 such that the solution discharge chamber is substantially symmetrically formed between the front and back plates 140, 142. Alternatively, the cavity 160 is formed by a single enlarged one of either of upper channels 162, 164 formed in the respective front or back plate 140, 142. However it is formed the cavity 160 defines an elongated upper solution distribution and pressure equalization chamber that is structured for receiving the pressurized hot liquid cleaning solution through communication with the solution inlet orifice 158. The pressure equalization chamber 160 is effectively sized and shaped for reducing the fluid pressure from the incoming pressure as the cleaning solution expands to fill the chamber, and is further effectively sized for substantially equalizing the fluid pressure throughout the elongated chamber 160. In order to accomplish the foregoing solution distribution and pressure equalization functions, the cavity 160 is formed having substantially uniform length 166, height 168 and depth 170 dimensions with the length dimension 166 being much greater than the height dimension 168, and the height dimension 168 being much greater than the depth dimension 170. By example and without limitation, the length dimension 166 of the cavity 160 defining the elongated pressure equalization chamber is nearly as long as the overall length dimension 154 of the novel solution injection bar 122, or about thirteen inches to about thirteen and one half inches when the height dimension 168 is only about one quarter inch to about three eighths inch and the depth dimension 170 is only about one eighth inch which is divided about evenly between the mating upper channels 162, 164 in the respective front and back plates 140, 142. The extreme ratios of length dimension 166 to height dimension 168, and height dimension 168 to depth dimension 170 are effectively dimensioned for reducing the pressure of incoming cleaning solution received at the inlet orifice 158 as the pressurized fluid expands through the channel 160, and substantially equalizing the pressure in the liquid cleaning solution along the entire elongated upper pressure equalization chamber 160.

Optionally, one or more additional cleaning solution inlet orifices 158*a* and 158*b* may be provided in the elongated upper pressure equalization chamber 160 in fluid communication with the source of hot liquid cleaning solution through the cleaning solution delivery tube 112. The additional one or more inlet orifices 158*a*, 158*b*, if present, provide a more distributed flow of cleaning solution to the upper chamber 160. For example, according to one embodiment one additional cleaning solution inlet orifice 158*a* is positioned by example and without limitation adjacent to a second end of the solution injection bar 122 opposite from the original inlet orifice 158. In another embodiment, another additional cleaning solution inlet orifice 158*b* is positioned by example and without limitation midway along the elongated upper pressure equalization chamber 160 between the first inlet orifice 158 and second inlet orifice 158*a*.

A cleaning solution flow restrictor 172 fluidly communicates between the pressure equalization chamber 160 and a cooperating elongated lower solution discharge chamber 174 that is substantially contiguous therewith. The solution flow restrictor 172 is formed in the substantially rigid elongated structure of the solution injection bar 122 between mating interior faces 144, 146 of the respective front and back plates 140, 142. The cleaning solution flow restrictor 172 is substantially contiguous with the pressure equalization chamber 160 and is structured to restrict fluid discharge of the cleaning solution to the cooperating lower solution discharge chamber 174. The flow restrictor 172 is thus structured to develop sufficient back pressure in the pressure equalization chamber 160 to effectively accomplish both the solution distribution and pressure equalization functions of the cavity 160, as disclosed herein. The flow restrictor 172 is thus suitably structured to fluidly communicate the liquid cleaning solution from the pressure equalization chamber 160 to the cooperating lower solution discharge chamber 174 in a substantially uniform flow along substantially the entire length 166 of the pressure equalization chamber 160.

By example and without limitation, the cleaning solution flow restrictor 172 is optionally provided as a plurality of substantially identical flow restriction orifices 176 formed in the substantially rigid elongated structure of the solution injection bar 122 between mating interior faces 144, 146 of the respective front and back plates 140, 142. The array of flow restriction orifices 176 is distributed at substantially uniform intervals along substantially the entire length 166 of the elongated pressure equalization chamber 160 and in fluid communication between the upper pressure equalization chamber 160 and the lower solution discharge chamber 174. As disclosed in more detail below, the flow restriction orifices 176 are structured to fluidly communicate the liquid cleaning solution from the pressure equalization chamber 160 to the solution discharge chamber 174 in a substantially uniform spray along the length 166 of the pressure equalization chamber 160.

The lower solution discharge chamber 174 is positioned in the solution injection bar 122 for receiving the pressure equalized cleaning solution from the elongated pressure equalization chamber 160 in a substantially uniform flow through the array of flow restriction orifices 176 there between. The lower solution discharge chamber 174 is further positioned for delivering the liquid cleaning solution to the cleaning head operating surface 126 in a substantially uniform pressurized flood. In the assembled solution injection bar 122, the lower solution discharge chamber 174 forms an elongated cleaning solution discharge slot 178 adjacent to the lengthwise edge of the solution injection bar 122 and in fluid communication with the cleaning head operating surface 126. The cleaning solution discharge slot 178 is at least as long as the elongated solution discharge chamber 174 and substantially contiguous therewith.

By example and without limitation, the solution discharge chamber 174 is an elongated cavity formed by a pair of substantially identical mating lower channel 180 and 182 recessed in respective substantially planar interior faces 144, 146 of front and back plates 140, 142. Accordingly, the solution discharge chamber 174 is optionally substantially symmetrically formed between the front and back plates 140, 142. Alternatively, the elongated cavity forming the solution discharge chamber 174 is provided by a single enlarged one of either of lower channel 180, 182 formed in the respective front or back plate 140, 142. Regardless of how it is formed the elongated solution discharge chamber 174 is effectively structured for receiving the substantially uniform flow of pressurized liquid cleaning solution as a spray through orifices 176 from the elongated pressure equalization chamber 160, and delivering a substantially uniformly pressurized flood of the cleaning solution to the cleaning head operating surface 126 substantially continuously along substantially the entire length dimension 154 of the solution injection bar 122.

By example and without limitation, the elongated cavity forming the solution discharge chamber 174 is about the same size and shape as the elongated cavity forming the upper pressure equalization chamber 160. For example, the elongated solution discharge chamber 174 is formed having substantially uniform length 184, height 186 and depth 188 dimensions with the length dimension 184 being much greater than the height dimension 186, and the height dimension 186 being much greater than the depth dimension 188. By example and without limitation, the length dimension 184 of the solution discharge chamber 174 is as much as ten to fourteen inches long or nearly as long as the overall length dimension 154 of the novel solution injection bar 122, or about thirteen inches to about thirteen and one half inches, when the height dimension 186 is only about one quarter inch to about three eighths inch and the depth dimension 188 is only about one eighth inch divided about evenly between lower channel 180, 182 in the respective front and back plates 140, 142.

Optionally, a baffle 190 is formed in the elongated cleaning solution discharge slot 178 in fluid communication between the solution discharge chamber 174 and the cleaning head operating surface 126. The baffle 190, if present, reduces the solution discharge slot 178 to a narrow slot. The resultant narrower solution discharge slot 178 aids in reducing the spray of cleaning solution sprayed from the upper pressure equalization chamber 160 through the flow restriction orifices 176 into a substantially uniform thin sheet upon exiting the solution discharge chamber 174 and encountering operating surface 126 of the solution injection bar 122. The optional baffle 190, if present in the cleaning solution discharge slot 178, also aids in reducing cleaning solution penetration into the target carpet. By example and without limitation, the optional baffle 190, if present, is embodied having an extruded funnel shape formed by a pair of shelves 192 and 194 extended inwardly of the respective mating lower channel 180, 182 forming the solution discharge chamber 174 along substantially the entire length 184 of the lower solution discharge chamber 174 and cleaning solution discharge slot 178. The shelves 192, 194 are each recessed a distance 195 about 0.004 inch to 0.005 inch relative to the substantially planar interior faces 144, 146 of respective mating plates 140, 142 to reduce the elongated cleaning solution discharge slot 178 to about 0.008 inch to 0.010 inch or less in width along substantially the entire length 184 of the solution discharge chamber 174. However, the inventor has determined that widths of 0.010 inch to about 0.017 inch or even as much as 0.020 inch for the cleaning solution discharge slot 178 are also effective for forming the uniform sheet of liquid cleaning solution. The narrow width of the cleaning solution discharge slot 178 is not required to develop back pressure in the pressure equalization chamber 160, rather back pressure is developed in the pressure equalization chamber 160 by fluid discharge restriction of the flow restriction orifices 176.

By example and without limitation, the cooperating shelves 192, 194 are optionally formed to include a V-shape that extends at least the length 184 of the solution discharge chamber 174 and cleaning solution discharge slot 178. Accordingly, the cooperating shelves 192, 194 optionally form oppositely angled surfaces 196 and 198 that open onto the elongated cleaning head operating surface 126 of the solution injection bar 122. Optionally, the two surfaces 196, 198 of the baffle 190 each form an angle of 30 degrees to about 60 degrees or more as measured from the respective upright walls 148, 150 of the respective back plates 140, 142, i.e., an angle relative to the planar operating surface 126 of the solution injection bar 122. The two surfaces 196, 198 of the baffle 190 thus form an included angle in the range of about 60 degrees to about 120 degrees. According to one embodiment the angled baffle surfaces 196, 198 are each oriented at about 45 degrees so as to form an included angle of about 90 degrees. The angled baffle surfaces 196, 198 thus form an acute angle to the solution injection bar operating surface 126 and the surface to be cleaned.

The acute angular orientation of the baffle surfaces 196, 198 relative to the solution injection bar operating surface 126 is effective for reducing the tendency of the pressurized liquid cleaning solution to penetrate deep into the carpeting to be cleaned. The angle of the two baffle surfaces 196, 198 causes the liquid cleaning solution to remain near the surface of the carpet so that the vacuum source more efficiently withdraws the spent cleaning solution from the carpet nap and pulls it across the planar cleaning head operating surface 126. Because the liquid cleaning solution remains near the surface of the nap, the carpet dries very rapidly, being almost dry to the touch immediately following passage of the cleaning head 106. In contrast, a more upright or vertical discharge slot tends to drive the cleaning solution comparatively more deeply into the nap, and the carpet requires comparatively longer to dry. Effectiveness in reducing cleaning solution penetration is enhanced when the baffle surfaces 196, 198 are oriented closer to parallel with the cleaning surface of the cleaning head operating surface 126, rather than perpendicular thereto. Therefore, according to one embodiment of the invention, the surfaces 196, 198 of the baffle 190 are oriented at about 30 degrees to 45 degrees which also minimizes any tendency for the trailing edge of the baffle 190 to snag on the carpeting or other surface to be cleaned.

Alternatively, the two baffle surfaces 196, 198 are optionally substantially parallel. Parallelism of the baffle surfaces 196, 198 enhances the formation of the uniform sheet of liquid cleaning solution. Furthermore, when parallel the two baffle surfaces 196, 198 are spaced only a short distance apart so that the cleaning solution discharge slot 178 is very narrow, which also enhances the formation of the uniform sheet of liquid cleaning solution. According to one embodiment, the two baffle slot surfaces 196, 198 are spaced apart on the order of about 8 to 10 thousands of an inch or less such that the angled cleaning solution discharge slot 178 is on the order of about 0.008 inch to 0.010 inch or less in width along substantially the entire length 184 of the solution discharge chamber 174. However, as disclosed herein the inventor has determined that widths of 0.010 inch to about 0.017 inch or even as much as 0.020 inch for the cleaning solution discharge slot 178 are also effective for forming the uniform sheet of liquid cleaning solution.

In the cleaning head assembly 106, the substantially rigid elongated structure of the solution injection bar 122 is positioned in the cleaning head body 120 between the pair of rigid cleaning solution extraction or retrieval slots 128, 130 formed adjacent to opposite edges of the cleaning head operating surface 126 and substantially contiguous therewith. For example, the cleaning solution retrieval slots 128, 130 are long narrow substantially continuous slots formed along substantially the entire width 124 of the cleaning head body 120 on either side of the lengthwise edge of the solution injection bar 122 having the operating surface 126. Alternatively, the cleaning solution retrieval slots 128, 130 are formed as a plurality of narrowly spaced apertures or short slots formed in a linear array aligned along substantially the entire width 124 of the cleaning head body 120. Regardless of configuration the cleaning solution retrieval slots 128, 130 are coupled to the vacuum hose 104 for communicating with the vacuum source 101. The vacuum control switch 110 is provided for controlling the vacuum source 101.

As illustrated here by example and without limitation, the cleaning solution extraction or retrieval slots 128, 130 are embodied as a pair of elongated channels formed between the outer walls 148, 150 of the solution injection bar's rigid front and back plates 140, 142 and a pair of outer face plates 210 and 212. The outer face plates 210, 212 are narrowly spaced away from the respective outer walls 148, 150 of the front and back plates 140, 142 by short spacers 214 and 216. The cleaning solution retrieval slots 128, 130 are thus formed between the front and back plates 140, 142 and the respective outer face plates 210, 212 with the spacers 214, 216 holding the slots 128, 130 open along substantially the entire width 124 of the cleaning head body 120. Spacers 214, 216 are short to make the retrieval slots 128, 130 narrow to minimize the opportunity for the fluid extraction airstream to pull up the fabric, as discussed herein. Spacers 214, 216 are optionally integral with either the front and back plates 140, 142 or the respective outer face plates 210, 212. Furthermore, the spacers 214, 216 are set back from the cleaning head operating surface 126 sufficiently to permit the fluid extraction airstream to flow substantially unimpeded into the vacuum chamber 132 and thence the vacuum hose 104.

The outer face plates 210, 212 are formed with respective elongated skid surfaces 218 and 220 that will face and contact the carpet on opposite sides of the cleaning head operating surface 126. The face plate skid surfaces 218, 220 are substantially contiguous with the entire length of the respective outer face plates 210, 212. The face plate skid surfaces 218, 220 are substantially smooth and planar and are positioned substantially coplanar with the cleaning head operating surface 126 so as to effectively contact the target surface. Face plate skid surfaces 218, 220 are optionally embodied as glide surfaces formed of a low friction material that permits the cleaning head 106 to move more easily across the carpet or other target surface to be cleaned. For example, the low friction glide surfaces 218, 220 and optionally the entirety of outer face plates 210, 212 are formed of nylon or Teflon material, or another low friction material. According to one embodiment, the low friction glide surfaces 218, 220 extend substantially the entire width 124 of the cleaning head 106. The low friction glide surfaces 218, 220 are thus positioned on the leading and trailing edges of the cleaning head operating surface 126 to contact the carpet or other target surface to be cleaned. Thus positioned, the low friction glide surfaces 218, 220 decrease friction between the operating surface 126 of the solution injection bar 122 and the carpet or other target surface as the cleaning head 106 travels over the carpeted surface. The low friction glide surfaces 218, 220 are thus positioned to minimize wear and tear on carpeted surfaces as well as other target surface to be cleaned. In contrast, before introduction of low friction glide surfaces 218, 220, prior art fluid cleaning devices were required to limit the suction power of solution retrieval slots so as to permit the cleaning head to be moved across the carpet without excessive strain on the operator. Accordingly, care needed to be exercised in switching between consecutive fluid cleaning and dry vacuuming passes because fluid cleaning solution tends to drip from the prior art cleaning head and the fluid extraction airstream of the vacuum generated in the retrieval slots was not sufficient to retrieve droplets of the cleaning solution before they dripped onto the carpet. Therefore, if insufficient care was exercised, the operator left wet spots of cleaning solution at the end of each fluid cleaning pass. In the present cleaning head 106 the low friction glide surfaces 218, 220 permit it to move more easily across the carpet so the fluid extraction airstream of the vacuum generated at the solution retrieval slots 128, 130 can be great enough to capture and remove excess fluid cleaning solution dripped from the operating surface 126 of the solution injection bar 122. Accordingly, the low friction glides 218, 220 permit sufficient vacuum pressure in the solution retrieval slots 128, 130 for capture and removal of excess cleaning solution, which permits the dry vacuum passes to be alternated with fluid cleaning passes in the present cleaning head 106 without suffering the wet spots left behind by prior art devices at the end of each fluid cleaning pass.

Optionally, the outer face plates 210, 212 are formed with a plurality of cleaning solution extraction or retrieval ports 222 and 224 configured as an array of tubular apertures communicating between respective the glide surfaces 218, 220 and the vacuum chamber 132 of the cleaning head 106. By example and without limitation, the retrieval ports 222, 224 are arrayed along substantially the entire length of the glide surfaces 218, 220 of the respective outer face plates 210, 212 substantially parallel with the solution retrieval slots 128, 130. Optionally, the tubular retrieval ports 222, 224 are sized large enough to pass solid contaminants with the spent cleaning solution extracted from the carpet without clogging. The optional retrieval ports 222, 224, if present, are openings into the vacuum chamber 132 of the cleaning head 106 and therefore operate in combination with the retrieval slots 128, 130 to increase the overall fluid retrieval area of the cleaning head 106 for maximizing the air flow of the fluid extraction airstream. As discussed herein, maximizing air flow of the fluid extraction airstream is one of the factors in maximizing extraction or retrieval of the spent cleaning solution. However, the material of the respective the glide surfaces 218, 220 effectively separates the retrieval slots 128, 130 and retrieval ports 222, 224 and operates as a guard to hold the target fabric down and keep it from being sucked up into the cleaning head 106 by the vacuum pressure of the fluid extraction airstream.

In operation, the cleaning head 106 is generally moved straight forward and straight reverse across a carpet, therefore, as viewed from below, the discharge slot 178 of the solution discharge chamber 174 and the planar operating surface 126 are formed in the lengthwise edge of the solution injection bar 122 along substantially the entire width 124 of the cleaning head body 120.

By means disclosed in detail below, the liquid cleaning solution enters the pressure equalization chamber 160 in the solution injection bar 122 in a steady stream through the solution inlet orifice 158 and optional additional inlet orifices 158*a*, 158*b*, if present, and impacts against the walls 148, 150 of respective front and back plates 140, 142 adjacent to the flow restriction orifices 176. The walls 148, 150 of front and back plates 140, 142 operate as striker plates to disperse the pressurized liquid cleaning solution which expands throughout the pressure equalization chamber 160. Dispersion and expansion within the chamber 160 partially relieves the pressure of the incoming cleaning solution and substantially equalizes the pressure throughout the pressure equalization chamber 160. Dispersion and pressure equalization causes the liquid cleaning solution to flow in substantially uniform streams from each and every one of the flow restriction orifices 176 distributed along the length 166 of the pressure equalization chamber 160. Accordingly, the cleaning solution flows out of the pressure equalization chamber 160 into the lower solution discharge chamber 174 in substantially uniform flow along its entire length 184. The flow restriction orifices 176 of the solution flow restrictor 172 are sized and numbered such that the liquid cleaning solution is discharged from the lower solution discharge chamber 174 at a volumetric flow rate of or about 1 gallon per minute (gpm) or less, so that the liquid cleaning solution is discharged to the operating surface 126 as a flood under pressure. The pressurized flood of liquid cleaning solution is discharged from the flow restriction orifices 176 as a spray that projects less than about 2 to 3 inches out from the operating surface 126. The optional baffle 190, if present, yet further reduces any spray from the solution flow restrictor 172 to a pressurized flood at the operating surface 126.

As indicated by the arrows, the substantially uniform thin sheet of liquid cleaning solution is drawn across the operating surface 126 and into the solution retrieval slots 128, 130 and the vacuum hose 104 via the fluid extraction airstream produced by a vacuum formed therein for delivery to the waste receptacle 102.

According to one embodiment, the cleaning solution retrieval slots 128, 130 are formed having a width 226 selected to be a minimum width that is just wide enough to receive the spent cleaning solution and soil dissolved therein. Minimizing the width 226 of the solution retrieval slots 128, 130 maximizes the vacuum or negative pressure for optimal extraction of the spent cleaning solution and dissolved soil.

However, it is generally well known that hair, dirt, gravel and other extraneous large debris are often present before the carpet or other target surface is cleaned. Therefore, it was well known in the prior art to initially dry vacuum the carpet or other target surface to pick up such large debris in a first pass prior to fluid cleaning so the prior art solution retrieval slots would not be clogged by such extraneous debris during fluid cleaning. Thus, only after a first dry vacuuming pass was the fluid cleaning pass possible. Accordingly, the operator had to either completely dry vacuum the carpet in an initial debris removal step before fluid cleaning, else alternate between a first dry vacuuming pass in a first direction and a second fluid cleaning pass in a reverse direction from the dry vacuuming pass. This limitation on the ability of the cleaning head to pick up large debris in the same pass with extraction of the spent cleaning solution necessarily doubled the length of time necessary for cleaning the soiled carpet. This limitation was exacerbated by difficulties in operating the dry vacuum and fluid clean controls, whereby the operator quickly tired from stopping and starting the cleaning solution flow with each pass.

Therefore, according to one embodiment, the width 226 of the cleaning solution retrieval slots 128, 130 is optionally selected to be large enough to permit solid contaminants that can be expected to be in the dirty cleaning liquid to pass through the cleaning solution retrieval slots 128, 130 without clogging these retrieval slots 128, 130. The cleaning solution retrieval slots 128, 130 are thus large enough to receive hair, dirt, gravel and other large debris without clogging. The cleaning head 106 is thus operated to simultaneously pick up both debris and spent cleaning solution in a single pass so the carpet does not require dry vacuuming prior to fluid cleaning as was known in the prior art. According to this embodiment having a large width 226 for the cleaning solution retrieval slots 128, 130, the carpet or other target surface is dry vacuumed with the cleaning head 106, then cleaned with fluid in same pass. This embodiment thus greatly reduces the time required for actual cleaning by incorporating the dry vacuuming step into the fluid cleaning process. Furthermore, the cleaning system 100 provides for switching between the fluid cleaner and dry vacuum processes of the cleaning head 106 by means of the cleaning solution flow control switch or valve 114 for stopping flow of the cleaning solution to the solution injection bar 122. The solution flow control 114 is turned ON to allow the cleaning head 106 to be operated in a fluid cleaning mode with a constant flow of liquid cleaning solution to clean the carpet, then the solution flow control 114 is turned OFF to stop flow of the liquid cleaning solution while the vacuum is applied to the cleaning solution retrieval slots 128, 130 whereby the cleaning head 106 is operated in a dry vacuum mode for completing drying of the carpet. Optionally, the solution flow control switch or valve 114 includes a LOW selector for selecting a reduced flow of cleaning solution in the fluid cleaning mode.

According to one embodiment, the cleaning head 106 optionally includes one or more of the dry vacuum slots 134 which are sized large enough to receive hair, dirt, gravel and other extraneous large debris. The dry vacuum slots 134 each have an elongated mouth 228 that is elongated to extend substantially the entire width 124 of the cleaning head 106 and is further positioned adjacent to the solution injection bar 122, and substantially coplanar with the cleaning head operating surface 126. By example and without limitation, the one or more dry vacuum slots 134 are positioned on either side of the cleaning solution retrieval slots 128, 130 on either the nominal front 136 or back 138 (shown) of the cleaning head 106. The dry vacuum slots 134 fluidly communicate with the vacuum hose 104 which in turn communicates with the main waste receptacle 102 of the cleaning system 100.

Furthermore, the cleaning head 106 optionally includes a removable self-sealing cap or stopper 230 that seals the dry vacuum slots 134 and effectively interrupts communication with the vacuum hose 104 and the source of vacuum 101. The dry vacuum slots 134 are thus positioned either to initially pre-vacuum the carpet before fluid cleaning, or else to operate with the cleaning solution retrieval slots 128, 130 as additional solution retrieval slots for assisting in completing drying of the carpet. Operation of the removable self-sealing cap 230 permits the cleaning head 106 to be easily switched between the fluid cleaning mode and the dry vacuum mode by removal and replacement (arrows 232) thereof. When the cleaning head 106 is operated in the fluid cleaning mode, the additional wider dry vacuum slots 134 pick up larger debris so that an initial pre-vacuuming step is not required to pick up debris before fluid cleaning the carpet, while the additional dry vacuum slots 134 are optionally utilized to assist the cleaning solution retrieval slots 128, 130 in drying of the carpet. Accordingly, dry vacuuming and fluid cleaning are accomplished simultaneously in a single pass. Else, when the cleaning head 106 is operated in the dry vacuum mode, the additional dry vacuum slots 134 are utilized either for accomplishing an optional initial dry vacuuming step to pick up debris before fluid cleaning the carpet, or the additional dry vacuum slots 134 are utilized in combination with the cleaning solution retrieval slots 128, 130 to assist in drying of the carpet.

Figure 5A:
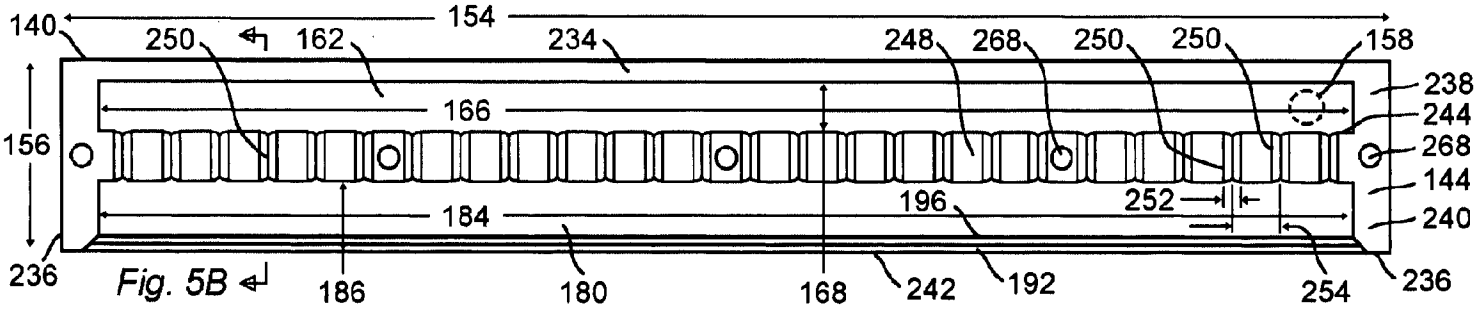

FIGS. 5A-5F illustrate one embodiment of the solution injection bar 122. FIG. 5A is a front elevation view that illustrates one of the rigid front plate 140 (shown) or back plate 142 of the solution injection bar 122. The rigid front plate 140 is formed with the elongated length dimension 154 of the novel solution injection bar 122, the much lesser the height dimension 156 and a thickness 233 that is about one half of the still much lesser thickness dimension 152 of the solution injection bar 122, as disclosed herein. The front plate 140 is formed with the upper channel 162 that is combined with the upper channel 164 in the mating back plate 142 to form the substantially sealed cavity 160 there between. The upper channel 162 is recessed into the substantially planar interior face 144 of the front plate 140 having the length 166, height 168 dimensions that form the cavity 160, as disclosed herein, and a depth dimension 235 approximately one half the depth 170 dimension of the cavity 160. As illustrated here, the elongated upper channel 162 is bordered at the upper edge of the solution injection bar 122 by an elongated upper lengthwise edge portion 234 of the front plate 140, and is further terminated at the lengthwise extents of the solution injection bar 122 by a pair of terminal end portions 236. The length 162 of the upper channel 162 is nearly as long as the overall length 154 of the front plate 140. For example, the upper channel length 166 is shorter than the front plate overall length 154 only by a pair of terminal channel portions 238 embodied as narrow end walls formed by the terminal end portions 236 of the front plate 140, which terminal channel portions 238 terminate opposite ends of the upper channel 162.

The front plate 140 is also formed with the lower channel 180 that is combined with the lower channel 182 in the mating back plate 142 to form the elongated lower cavity 174 that forms a solution expansion and discharge chamber in the solution injection bar 122 adjacent to the cleaning head operating surface 126 thereof and in fluid communication therewith. The lower channel 180 is recessed into the substantially planar interior face 144 of the front plate 140 having the length 184, height 186 dimensions that form the elongated lower solution discharge chamber 174, as disclosed herein, and a depth dimension 239 approximately one half the depth 188 dimension of the lower chamber 174. As illustrated here, the length 184 of the elongated lower channel 180 is nearly as long as the overall length 154 of the front plate 140. For example, the lower channel length 184 is shorter than the front plate overall length 154 only by a pair of lower terminal channel portions 240 embodied as narrow end walls formed by the terminal end portions 236 of the front plate 140, which terminal channel portions 240 terminate opposite ends of the elongated lower channel 180. The lower channel 180 communicates with a substantially planar lower lengthwise edge portion 242 of the front plate 140 that cooperates with a counterpart of the back plate 142 to form the cleaning head operating surface 126.

The front plate 140 is shown here as having the wall 148 one of the angled surfaces 196 (shown) or 198 that combine to form the angled baffle 190 in the discharge slot 178 between the elongated lower solution discharge chamber 174 and the lengthwise edge portion 242 that forms part of the cleaning head operating surface 126.

As illustrated here the rigid front plate 140 includes an elongated center bar portion 244 positioned between the elongated upper channel 162 that forms the upper pressure equalization chamber 160 of the solution injection bar 122 and the elongated lower channel 180 that forms the lower solution discharge chamber 174. The center bar 244 of the front plate 140 mates with a corresponding center bar portion 246 of the mating back plate 142 to form there between the flow restriction orifices 176 of the cleaning solution flow restrictor 172 that communicates between the elongated upper pressure equalization chamber 160 of the solution injection bar 122 and the elongated lower solution discharge chamber 174. A surface 248 of the center bar portion 244 is substantially flush with the bar interior face 144. The center bar surface 248 is formed with a plurality of substantially identical discharge notches 250 formed as slots or grooves recessed therein. The discharge notches 250 are extended across the surface 248 of the center bar 244 so as to communicate between the upper channel 162 and the lower channel 180. The recessed notches 250 are substantially uniformly distributed along the surface 248 of the center bar 244, and the quantity of notches 250 is preferably large, the size of each slot or groove 224 is small, and the spacing between adjacent notches 250 is close. For example, according to one embodiment the discharge notches 250 are shallow grooves having a width 252 at the bar surface 248 sized about 0.004 to about 0.006 inch and spaced at intervals 254 measuring about one eighth inch. It will be understood that the discharge notches 250 are appropriately sized and spaced such that, when mated with the corresponding center bar 246 of opposing back plate 142, sufficient restriction is created on discharge of liquid cleaning solution so that appropriate back pressure is developed in the pressure equalization chamber 160 so that the cleaning solution is discharged to the lower solution discharge chamber 174 at the volumetric flow rate of or about 1 gallon per minute (gpm) or less, whereby the liquid cleaning solution is discharged as a flood under pressure. The appropriate size and distribution of the discharge notches 250 is optionally determined empirically or using engineering formulae well known to those of skill in the art. For example, the necessary engineering formulae may be embodied in a computer software program for computing the appropriate size and distribution of the discharge notches 250 which will vary depending upon the size and shape of the elongated upper pressure equalization chamber 160, particularly the length dimension 166 thereof, as well as the pressure and volumetric delivery rate of the cleaning solution to the cleaning head 106, and the desired volumetric flow rate from the elongated lower solution discharge chamber 174 of the solution injection bar 122 such that the liquid cleaning solution is discharged as a flood under pressure, whereby the pressurized flood of hot liquid cleaning solution is discharged from the flow restrictor 172 as a spray that projects less than about 2 to 3 inches out from the operating surface 126. Accordingly, other embodiments of the discharge notches 250 are also contemplated and may be substituted without deviating from the scope and intent of the present invention.

Figure 5C:
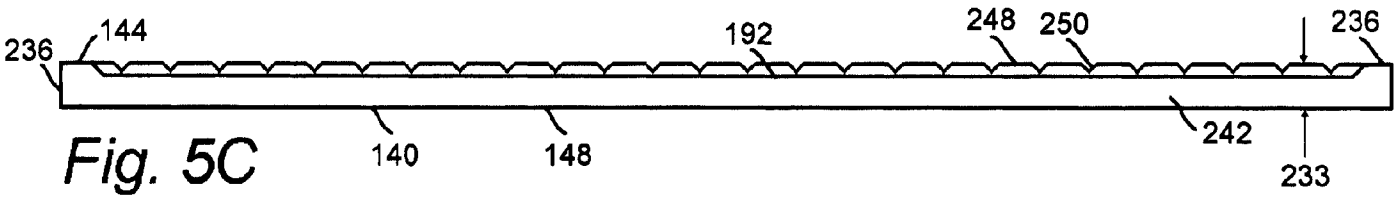
Figure 5D:
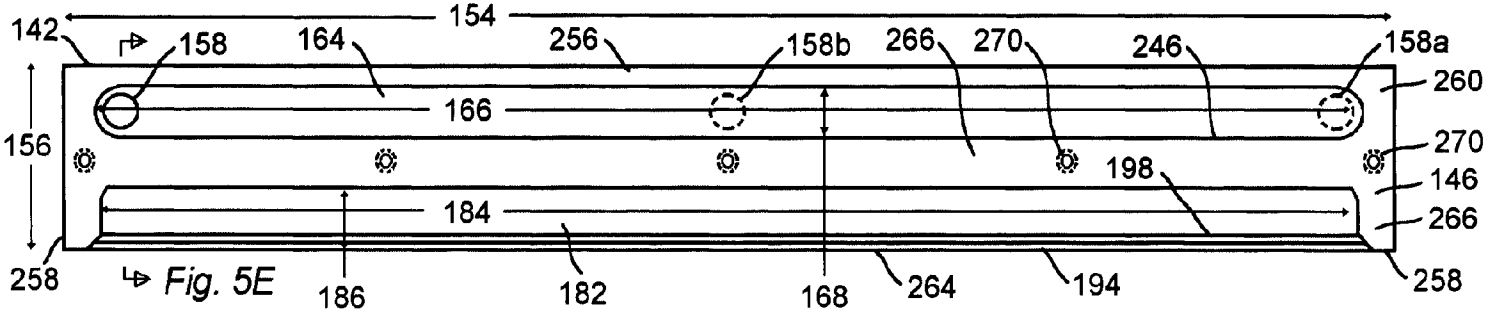
Figures 5B, 5E, 5F:
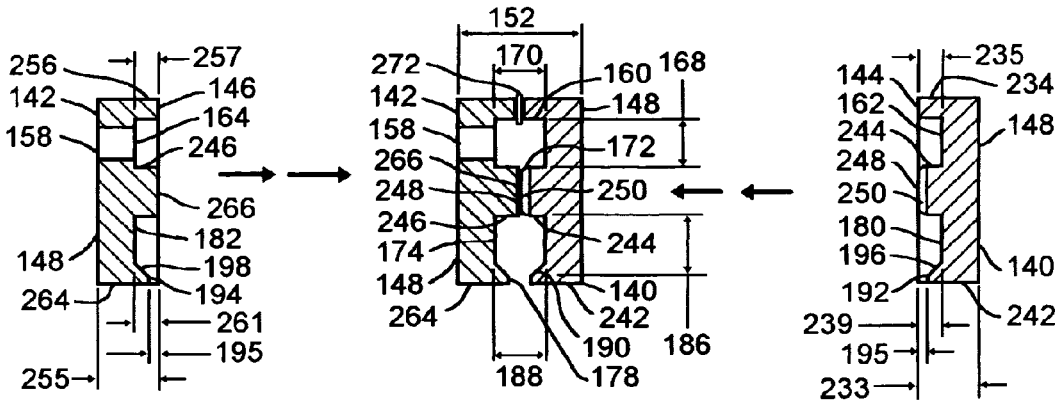

FIG. 5B is a cross section view through the front plate 140 shown in FIG. 5A at one of the discharge notches 250. Here, the surface 196 of the optional baffle shelf 192 is oriented at an acute angle to the lower lengthwise edge portion 242 of the front plate 140 that cooperates with a counterpart of the back plate 142 to form the cleaning head operating surface 126. Accordingly, the surface 196 of the optional baffle shelf 192 is angled at about 45 degrees and more generally in the range between about 30 degrees and 60 degrees to the cleaning head operating surface 126 and the surface to be cleaned. The optional baffle shelf 192, when present, also forms part of the cleaning head operating surface 126.

FIG. 5C is a bottom elevation view of the front plate 140 shown in FIG. 5A. Here, the plurality of substantially identical discharge notches 250 are formed in the inner surface 248 of the center bar portion 244 as substantially V-shaped discharge grooves substantially uniformly distributed along the inner surface 248. The V-shaped discharge grooves 250 extend between the upper channel 162 portion of the pressure equalization chamber 160 and the lower channel 180 portion of the lower solution discharge chamber 174.

FIG. 5D is a front elevation view that illustrates the back plate 142 that mates with the front plate 140 shown in FIG. 5A to form the solution injection bar 122. Similarly to the front plate 140, the rigid back plate 142 is formed with the elongated length dimension 154 of the novel solution injection bar 122, the much lesser the height dimension 156 and a thickness 255 that is about one half of the still much lesser thickness dimension 152, as disclosed herein. The back plate 142 is formed with the upper channel 164 that is combined with the upper channel 162 in the mating front plate 140 to form the substantially sealed cavity 160 there between. The upper channel 164 is recessed into the substantially planar interior face 146 of the back plate 142 having substantially the same length 166, height 168 dimensions that form the cavity 160, as disclosed herein, and a depth dimension 257 approximately one half the depth 170 dimension of the cavity 160.

As illustrated here, the elongated upper channel 164 is bordered at the upper edge of the solution injection bar 122 by an elongated upper lengthwise edge portion 256 of the back plate 142, and is further terminated at the opposing lengthwise extents of the solution injection bar 122 by a pair of terminal end portions 258. The length 162 of the upper channel 164 is nearly as long as the overall length 154 of the back plate 142. For example, the upper channel length 166 is shorter than the back plate overall length 154 only by a pair of upper terminal channel portions 260 embodied as narrow end walls formed by the terminal end portions 258 of the back plate 142, which terminal channel portions 260 terminate opposite ends of the upper channel 164.

The back plate 142 is also formed with the lower channel 182 that is combined with the lower channel 180 in the mating front plate 140 to form the elongated lower solution discharge chamber 174 in the solution injection bar 122 adjacent to the cleaning head operating surface 126 thereof and in fluid communication therewith. The lower channel 182 is recessed into the substantially planar interior face 146 of the back plate 142 having the length 184, height 186 dimensions that form the elongated lower solution discharge chamber 174, as disclosed herein, and a depth dimension 261 approximately one half the depth 188 dimension of the lower chamber 174. As illustrated here, the length 184 of the elongated lower channel 182 is nearly as long as the overall length 154 of the back plate 142. For example, the lower channel length 184 is shorter than the front plate overall length 154 only by a pair of lower terminal channel portions 262 embodied as narrow end walls formed by the terminal end portions 258 of the back plate 142, which terminal channel portions 262 terminate opposite ends of the elongated lower channel 182. The lower channel 182 communicates with a substantially planar lower lengthwise edge portion 264 of the back plate 142 that cooperates in a substantially coplanar relationship with the lower lengthwise edge portion 242 of the front plate 140 to form the cleaning head operating surface 126 in the assembled solution injection bar 122.

The back plate 142 is shown here as having one of the angled surfaces 196 or 198 (shown) that combine to form the optional angled baffle 190, if present, in the elongated cleaning solution discharge slot 178 between the lower solution discharge chamber 174 and the cleaning head operating surface 126. As illustrated here the rigid back plate 142 includes the center bar portion 246 that mates with corresponding center bar portion 244 of the mating front plate 140 to form there between the flow restriction orifices 176 of the solution flow restrictor 172 that communicate between the elongated upper pressure equalization chamber 160 of the solution injection bar 122 and the elongated lower solution discharge chamber 174. For example, the flush surface 248 of the center bar portion 244 of the mating front plate 140 substantially butts up against the corresponding center bar portion 246 of the mating back plate 142 to form individual flow restriction orifices 176 of the solution flow restrictor 172.

According to the embodiment illustrated here, the center bar portion 246 of back plate 142 is formed with an inner surface 266 that is substantially planar and flush with the back plate interior face 146 for mating with the plurality of discharge grooves 250 in the surface 248 of the center bar 244 of the front plate 140 to form there between the array of flow restriction orifices 176 of the solution flow restrictor 172. The center bar 246 is sized relative to the back plate 142 to physically contact the center bar 244 of the front plate 140 when assembled in the solution injection bar 122 with no gap there between. The individual discharge grooves 250 are thus isolated one from another by being recessed into the surface 248 of the center bar 244 while the intervening bar surface 248 mates against the surface 266 of corresponding center bar 246 of the opposing back plate 142.

According to the embodiment illustrated here, the back plate 142 also includes the cleaning solution inlet orifice 158 through the plate wall 150 and communicating with the upper channel 162 portion of the upper pressure equalization chamber 160. One or more additional cleaning solution inlet orifices 158*a* and 158*b* (shown in phantom) are optionally formed through the plate wall 150 in positions distributed along the length 166 of pressure equalization chamber 160. The additional inlet orifices 158*a*, 158*b*, if present, are coupled to the cleaning solution delivery tube 112 for receiving the pressurized cleaning solution and distributing the same within the sealed chamber 160.

FIG. 5E is cross section view through the back plate 142 shown in FIG. 5D. Here, the lower channel portion 182 of the lower solution discharge chamber 174 optionally includes the optional baffle shelf 194 projected from the plate wall 150. Furthermore, the surface 198 of the angled baffle shelf 194 is further oriented at about the same acute angle to the cleaning head operating surface 126 as the angled baffle shelf surface 196 in the front plate 140. By example and without limitation, the surface 198 of the angled baffle shelf 194 is oriented an acute angle to the cleaning head operating surface 126 of about 45 degrees and more generally in the range between about 30 degrees and 60 degrees to the cleaning head operating surface 126 and the surface to be cleaned. The optional baffle shelf 194, when present, forms part of the cleaning head operating surface 126.

FIG. 5F is a cross section view through the front and back plates 140, 142 mated in the assembly of the solution injection bar 122. Here, the rigid front and back plates 140, 142 are mechanically joined in such manner that upper channels 162 and 164 of respective front and back plates 140, 142 come together to form the upper pressure equalization chamber 160 there between and having the length 166, height 168 and depth 170 dimensions as disclosed herein. The mating lower channels 180, 182 come together to form the lower solution discharge chamber 174 between mated front and back plates 140, 142 and having the length 184, height 186 and depth 188 dimensions as disclosed herein. The inner surface 266 of the center bar 246 portion of back plate 142 is compressed against the surface 248 of the center bar 244 of front plate 140, whereby the discharge grooves 250 are isolated one from another to form the array of flow restriction orifices 176 of the solution flow restrictor 172 as disclosed herein. The solution flow restrictor 172 communicates between the upper pressure equalization chamber 160 and the lower discharge chamber 174, as disclosed herein. The lower discharge chamber 174 communicates with the cleaning head operating surface 126 of the solution injection bar 122 through the elongated cleaning solution discharge slot 178 formed between the mated front and back plates 140, 142. The optional shelves 192, 194, if present, are spaced apart on the order of about 8 to 10 thousands of an inch or less such that the angled cleaning solution discharge slot 178 is on the order of about 0.008 inch to 0.010 inch or less in width along substantially the entire length 184 of the solution discharge chamber 174.

The front and back plates 140, 142 are joined in any suitable manner, including by example and without limitation, a plurality of fasteners through appropriately sized cooperating apertures 268 and 270 formed through their walls 148, 148. According to one embodiment, the apertures 268 in through the wall 148 of the front plate 140 are clearance holes for the fasteners, while the apertures 270 through the wall 150 of the back plate 142 are suitably threaded to receive threaded fasteners. The cooperating apertures 268, 270 are positioned at intervals along the length 154 of the plates 140, 142 to ensure sealing of the chamber 160 formed there between. Positioning the cooperating apertures 268, 270 at intervals along the length 154 of the plates 140, 142 also ensures the inner surface 266 of the center bar 246 portion of back plate 142 is compressed against the surface 248 of the center bar 244 of front plate 140 for isolating adjacent discharge notches 250 one from another to form the array of flow restriction orifices 176 of the solution flow restrictor 172 as disclosed herein.

Furthermore, the upper cavity 160 is substantially sealed against leaking the pressurized cleaning solution by an optional gasket 272 clamped there between. The optional gasket 272, if present, is squeezed between the front and back plates 140, 142 by action of the fasteners through the cooperating apertures 268, 270 therein.

Figure 6A:
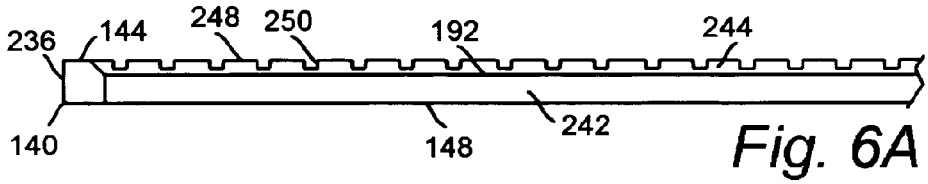

FIG. 6A illustrates an alternative embodiment of the cleaning solution flow restrictor 172 wherein the notches 250 of flow restriction orifices 176 is formed as a plurality of generally rectangular slots in one of the center bar portions 244, 246 of the respective front and back plates 140, 142.

Figure 6B:
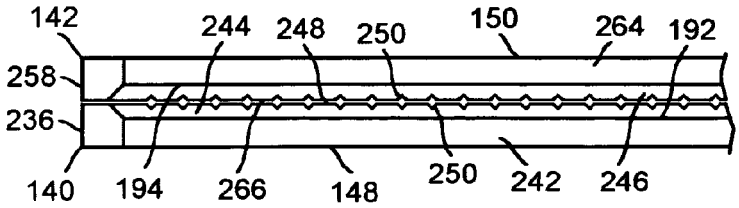

FIG. 6B illustrates another alternative embodiment of the cleaning solution flow restrictor 172 wherein the flow restriction orifices 176 is formed as a plurality of the V-shaped or generally rectangular discharge slots or grooves 250 formed in each of the center bar portions 244, 246 of the respective front and back plates 140, 142.

Here, the center bar portions 244, 246 of the respective front and back plates 140, 142 are formed as substantially mirror images. As such, the discharge slots or grooves 250 are formed in the center bar portions 244, 246 of both the front and back plates 140, 142 and are matched up to form the flow restriction orifices 176. However, the discharge slots or grooves 250 are smaller so that corresponding features in the mating center bar portions 244, 246 of the front and back plates 140, 142 add up to the equivalent throughput of larger slots or grooves 250 formed in only one of the front and back plates 140, 142, as disclosed herein.

Figure 6C:
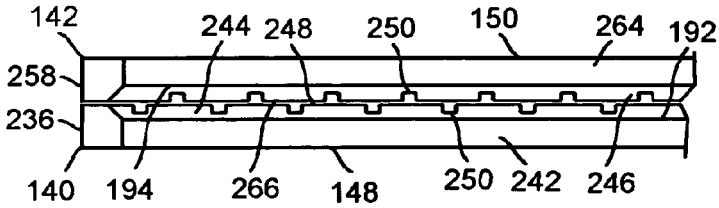

FIG. 6C illustrates still another alternative embodiment of the cleaning solution flow restrictor 172 wherein the notches 250 of the flow restriction orifices 176 are formed as a plurality of the V-shaped grooves or generally rectangular discharge slots formed in each of the center bar portions 244, 246 of the respective front and back plates 140, 142. Here, the discharge slots or grooves 250 are formed in the center bar portions 244, 246 of both the front and back plates 140, 142. But here, the discharge slots or grooves 250 are offset in the respective center bar portions 244, 246 so the discharge slots or grooves 250 in the center bar 244 of the front plate 140 line up with the flush inner surface 266 of the center bar portion 246 of back plate 142, and the discharge slots or grooves 250 in center bar portion 246 of the back plate 142 line up with the flush inner surface 248 of the center bar portion 244 of the front plate 140.

FIGS. 7A-7E illustrate one embodiment of one of the two outer face plates 210, 212 that cooperate with the solution injection bar's rigid front and back plates 140, 142 to form the cleaning solution extraction or retrieval slots 128, 130 on the cleaning head 106.

Figure 7B:
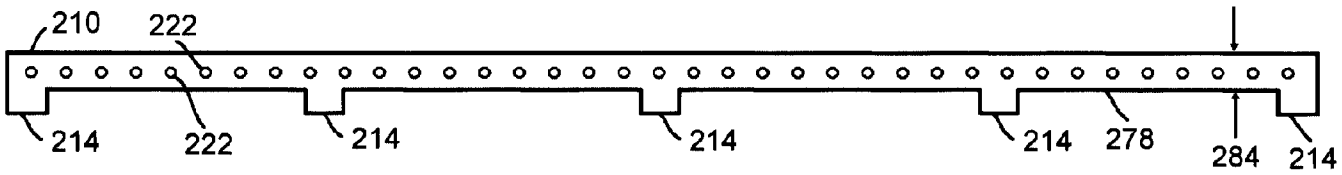
Figure 7A:
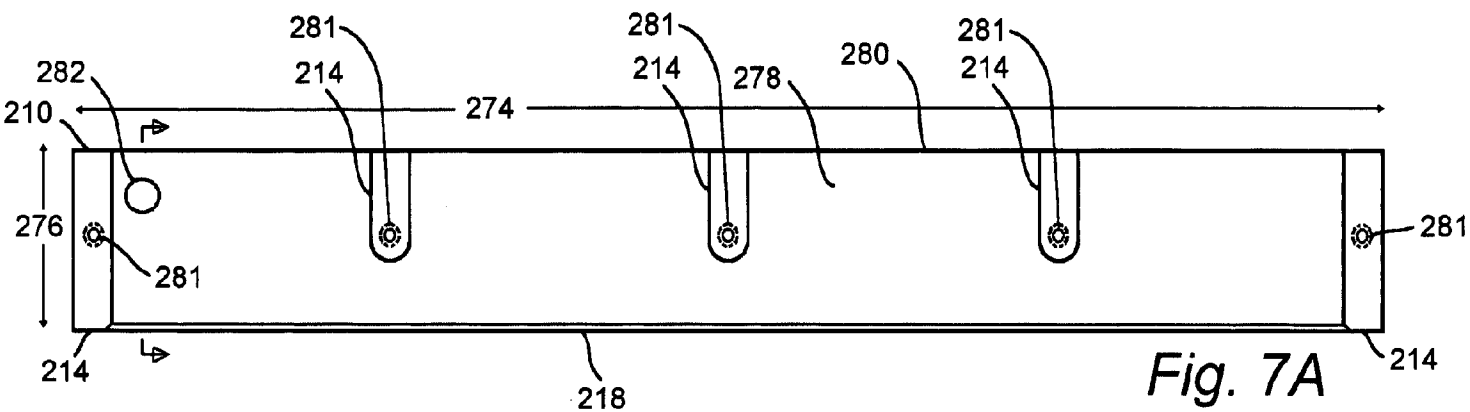

FIG. 7A further illustrates one outer face plate 210 having a length 274 substantially the same as the length 154 of the front and back plates 140, 142 and a height 276 substantially the same as the plate height 156 so as to match up when mounted on the outer walls 148, 150 of the two plates 140, 142. Here, one outer face plate 210 is shown having an operational surface 278 wherein the solution retrieval slot 128 is formed. Several of the spacers 214 project above the operational surface 278. The several spacers 214 include two end spacers 214 adjacent to opposite ends of the plate 210 and extending substantially the full height 276 of the plate 210, and several shorter spacers 214 intervening at intervals along the operational surface 278 between the end spacers 214. As illustrated, the end and intervening spacers 214 are sufficiently narrow relative to the length 274 of the face plate 210 as to cause minimal interruption of the fluid extraction airstream in the solution retrieval slots 128, 130. Furthermore, the shorter intervening spacers 214 are spaced away from the face plate glide surfaces 218, 220 and the operating surface 126 of the solution injection bar 122 to further reduce their effect on the fluid extraction airstream. The spacers 214 may extend to an upper edge portion 280 and are optionally positioned to coincide with the cooperating apertures 268, 270 formed in the outer plate walls 148, 150 for joining the front and back plates 140, 142. The spacers 214 thus positioned to cooperate with the front and back plates 140, 142 further include apertures 281 positioned to coincide with the cooperating apertures 268, 270 formed in the outer plate walls 148, 150 for receiving the fasteners.

Additionally, one of the face plates 210, 212 may be formed with an aperture 282 positioned to coincide with the cleaning solution inlet orifice 158 in one of the outer plate walls 148, 150 and sized to clear the cleaning solution delivery tube 112.

FIG. 7B is a top view of one of the face plates 210, 212 wherein the spacers 214 are shown to project above the operational surface 278. The face plate 210 is shown to have a thickness 284 sufficient to include the tubular cleaning solution retrieval ports 222, 224 distributed substantially uniformly along its entire length 274.

Figure 7C:
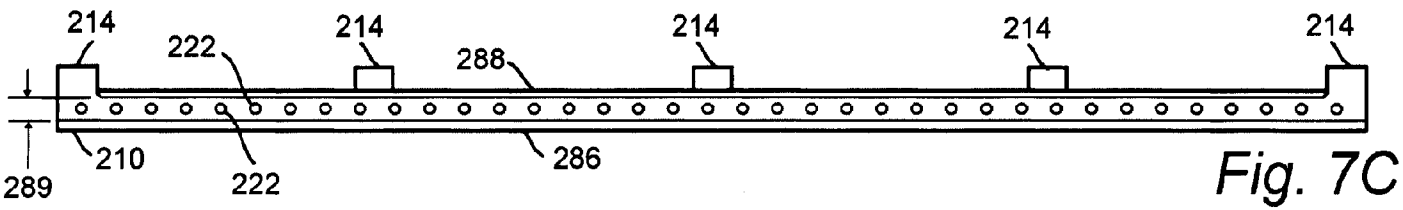

FIG. 7C is a bottom view of one of the face plates 210, 212 wherein the thickness 284 is further sufficient to provide the cleaning solution retrieval ports 222, 224 positioned within the substantially planar glide surfaces 218, 220. According to one embodiment, the portion of glide surfaces 218, 220 that will contact the carpet is substantially planar but may be beveled or rounded on respective leading and following edges 286 and 288. As illustrated here, the substantially planar portion of glide surfaces 218, 220 is sufficiently wide to encompass the cleaning solution retrieval ports 222, 224 spaced between the rounded or beveled leading and following edges 286, 288. Face plate glide surfaces 218, 220 are thus formed with a width 289 that is as much as two or more times greater than a cross sectional diameter of the tubular cleaning solution retrieval ports 222, 224 distributed there along.

Figure 7D:
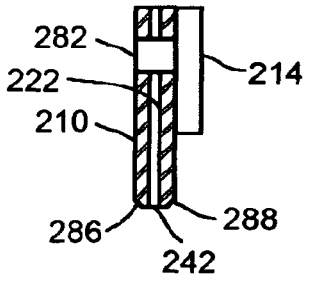

FIG. 7D is a cross-section of one of the face plates 210, 212 taken through the clearance aperture 282 for the cleaning solution delivery tube 112. As illustrated here, the tubular cleaning solution retrieval ports 222 extend through the face plate 210 between the glide surface 218 and the upper edge portion 280. Accordingly, the cleaning solution retrieval ports 222 effectively communicate between respective the glide surfaces 218, 220 and the vacuum chamber 132 of the cleaning head 106.

Figure 7E:
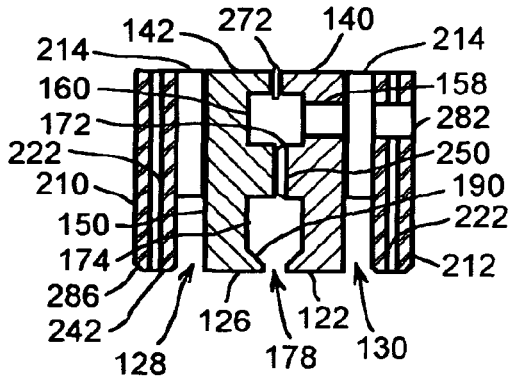

FIG. 7E is a cross-section view showing the outer face plates 210, 212 in combination with the solution injection bar's rigid front and back plates 140, 142 to form the cleaning solution extraction or retrieval slots 128, 130 on the cleaning head 106.

Figure 8F:
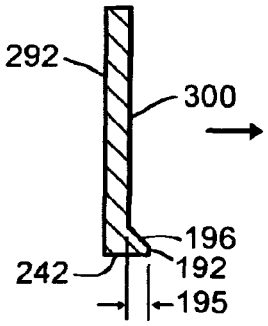
Figure 8A:
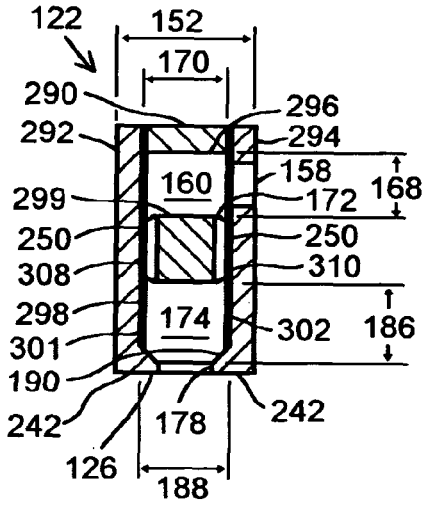

FIGS. 8A-8F illustrate another embodiment of the solution injection bar 122 formed of three cooperating substantially rigid elongated plates, including a middle plate 290 sandwiched between two substantially identical outside plates 292 and 294. FIG. 8A is a cross section taken through the solution injection bar assembly 122 showing the elongated upper pressure equalization chamber 160 configured as a single channel feature 296 formed entirely within the middle plate 290. The cooperating elongated lower solution discharge chamber 174 is configured as a single channel feature 298 formed entirely within the middle plate 290 and space away from the upper channel feature 296 by an elongated bar portion 299 of the middle plate 290. The thickness 300 of the middle plate 290 is thus substantially equivalent to the depth dimensions 170 and 188 of the upper and lower chambers 160 and 174.

Additionally, the discharge notches 250 of the cleaning solution flow restrictor 172 are formed in the middle bar portion 299 in one or both opposing exterior faces 308 and 310 of the middle plate 290. The outside plates 292, 294 are formed with substantially planar interior faces 301 and 302 that seat against the middle plate 290 to seal the upper chamber 160 and substantially butts up against the discharge notches 250 to form individual flow restriction orifices 176 of the solution flow restrictor 172. The interior faces 301, 302 of the outside plates 292, 294 also form the sides of the lower chamber 174 and provide the elongated cleaning solution discharge slot 178 between the lower solution discharge chamber 174 and the cleaning head operating surface 126. For example, the interior faces 301, 302 of the outside plates 292, 294 are formed with the angled surfaces 196, 198 terminating in the cleaning head operating surface 126. One of the outside plates 292 includes the cleaning solution inlet orifice 158 in a position for communicating with the channel feature 296 of the middle plate 290 forming the upper pressure equalization chamber 160.

Figure 8D:
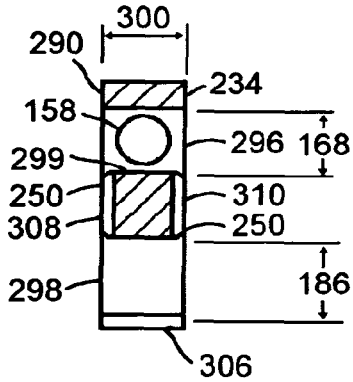
Figure 8B:
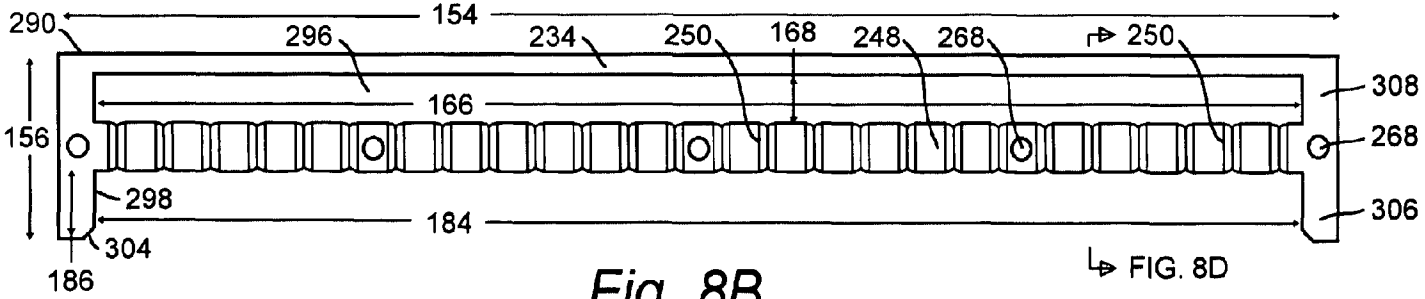

FIG. 8B is a side view of the elongated middle plate 290 showing the upper and lower channel features 296, 298 as well as the discharge notches 250 of the solution flow restrictor 172.

Figure 8C:
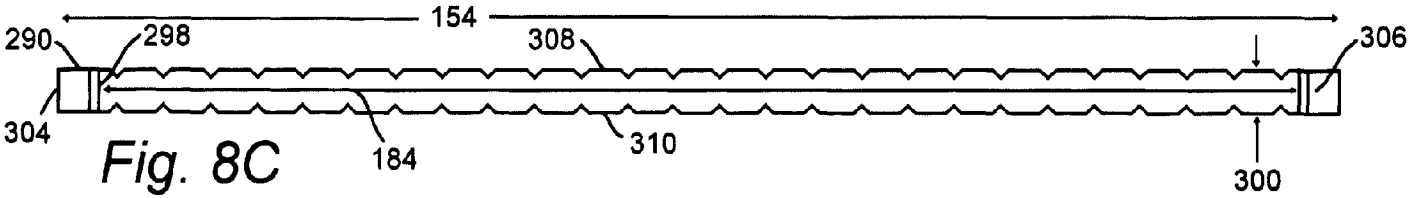

FIG. 8C is an bottom view of the elongated middle plate 290 showing the open lower channel feature 298 extending between opposing end portions 304 and 306. The discharge notches 250 of the solution flow restrictor 172 are shown here by example and without limitation as being formed one face 308 of the middle plate 290, and optionally on an opposite second face 310, as well.

FIG. 8D is a cross section view of the middle plate 290 showing by example and without limitation the cleaning solution inlet orifice 158 being optionally formed in one of the end portions 304, 306.

Figure 8E:
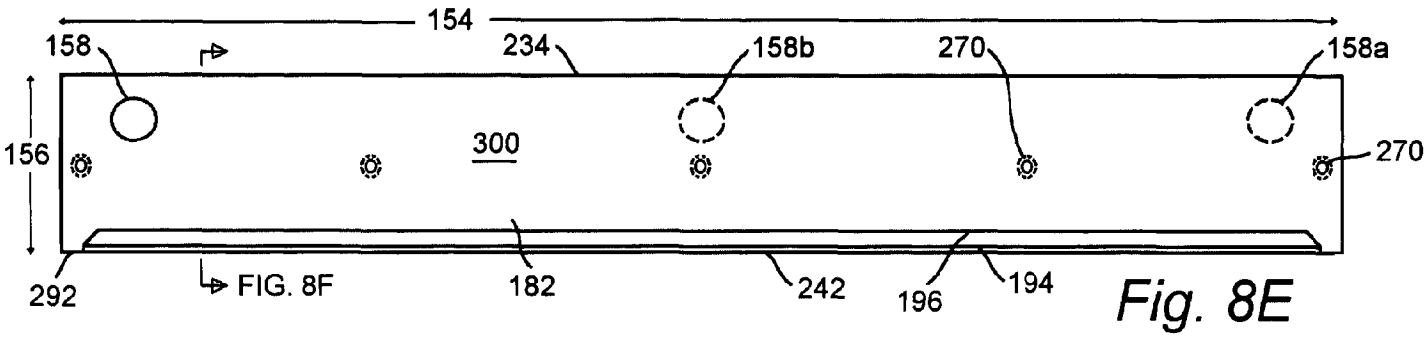

FIG. 8E illustrates the interior face 301 of one outside plate 292 being formed with one or more of the cleaning solution inlet orifice 158 and the apertures 268 or 270 for fasteners for interconnecting the outside plates 292, 294 on opposite sides of the middle plate 290.

FIG. 8F is a cross section view taken through one outside plate 292 being formed with the substantially planar lower lengthwise edge portion 242 that cooperates with a counterpart of the other outside plate 294 to form the cleaning head operating surface 126. The interior faces 301, 302 of respective outside plates 292, 294 are optionally also formed with the cooperating shelves 192, 194 and oppositely angled surfaces 196, 198 that form the optional baffle 190 in the cleaning solution discharge slot 178 of the solution discharge chamber 174, as disclosed herein.

Figure 9:
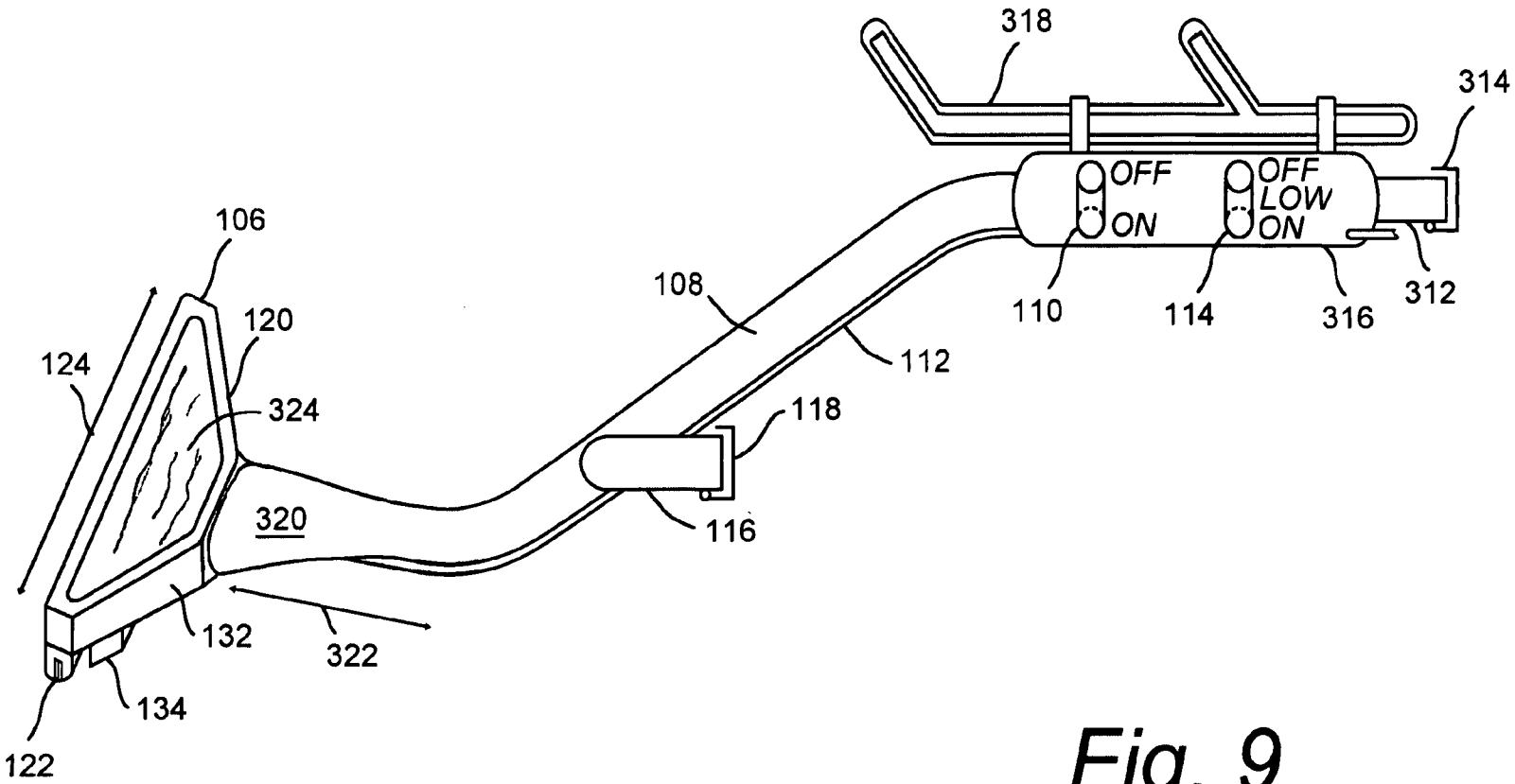
FIG. 9 is a detailed illustration of the cleaning head assembly and associated vacuum wand.

FIG. 9 is a detailed illustration of the cleaning head assembly 106 and associated wand 108. The wand 108 includes a proximal end portion 312 that is structured for connection to the main waste receptacle 102 via the vacuum hose 104. For example, the proximal end portion 312 of the wand 108 includes a sealable connector 314 for structured for connecting to the vacuum hose 104. The proximal end portion 312 of the wand 108 also supports a console 316 which includes the vacuum and cleaning solution flow control valves or switches 110 and 114, as disclosed herein. The vacuum control 110 is coupled to control vacuum pressure in the cleaning head assembly 106 through the wand 108, while the cleaning solution flow control 114 is coupled for controlling flow of the cleaning solution to the cleaning head assembly 106. For example, the vacuum control 110 is an electrical switch that remotely controls the vacuum source 101. Else, the vacuum control 110 is a valve structured for interrupting the airstream produced by the vacuum source 101. According to one exemplary embodiment, console 316 is structured to couple to the source of pressurized liquid cleaning solution via the cleaning solution delivery tube 112 such that the cleaning solution flow control 114 controls the flow of cleaning solution to the cleaning head assembly 106 as the cleaning solution delivery tube 112 extends to the cleaning head assembly 106. For example, the flow control 114 is an electrical switch that remotely controls the supply of pressurized hot liquid cleaning solution 101. Else, the flow control 114 is a valve structured for interrupting the flow of pressurized hot liquid cleaning solution through the cleaning solution delivery tube 112 to the cleaning head assembly 106. A handle 318 is coupled to the proximal end portion 312 for supporting the wand 108 and cleaning head assembly 106.

The cleaning head assembly 106 is coupled to a portion 320 of the wand 108 distal from the proximal end portion 312 and the console 316 supported thereby. A length 322 of about one foot to two feet or so of the distal wand portion 320 is structured to be substantially parallel with the low profile cleaning head assembly 106. Accordingly, the distal wand portion 320 is also structured to be low profile in combination with the low profile cleaning head assembly 106.

As also illustrated here, the body 120 carrying the novel solution injection bar 122 and optional dry vacuum slot 134, if present, further is configured in low profile for fitting under beds and other low furniture. Furthermore, the low profile cleaning head assembly 106 optionally includes a see-through porthole 324 that permits sight into the vacuum chamber 132 for viewing the spent cleaning solution and dissolved soil extracted from the carpet during fluid cleaning, as well as debris extracted during dry vacuuming. The operator is thus able to visually observe the spent cleaning solution as it is extracted from the carpet and thereby determine when the spent cleaning solution is extracted clean from the carpet to gauge when the cleaning is complete. Furthermore, during the dry stroke, the operator is further able to see spent cleaning solution being extracted so as to visually determine when the carpet is dry.

While the preferred embodiment of the invention has been illustrated and described, it will be appreciated that various changes can be made therein without departing from the spirit and scope of the invention.

What is claimed is:

1. A solution injection bar, comprising:

a substantially rigid bar comprising a pair of spaced apart outer walls terminating at substantially opposite ends in a pair of spaced apart terminal end portions with a lengthwise upper edge portion extended between the terminal end portions and a substantially planar lengthwise lower edge surface spaced apart therefrom and extended between the terminal end portions and defining an elongated and substantially planar cleaning head operating surface;

an elongated upper cavity formed interior of the bar adjacent to the lengthwise upper edge portion thereof and defining an elongated upper solution distribution and pressure equalization chamber that is arranged in fluid communication with a solution inlet orifice for receiving there through a flow of pressurized liquid cleaning solution, the elongated upper cavity further comprising a length dimension, a height dimension and a depth dimension with the length dimension being significantly greater than the height dimension;

a cleaning solution flow restrictor formed interior of the bar, the cleaning solution flow restrictor being substantially contiguous with the upper cavity between the spaced apart terminal end portions of the bar; and an elongated lower solution discharge chamber formed interior of the bar adjacent to the substantially planar lengthwise lower edge surface thereof and substantially contiguous with the cleaning solution flow restrictor between the spaced apart terminal end portions of the bar for receiving the liquid cleaning solution from the elongated upper cavity, the elongated lower solution discharge chamber being further positioned for delivering the received liquid cleaning solution to the cleaning head operating surface in a substantially uniform pressurized flood through an elongated cleaning solution discharge slot formed substantially contiguous with the elongated lower solution discharge chamber substantially opposite from the cleaning solution flow restrictor and adjacent to the lengthwise lower edge surface and arranged in fluid communication with the cleaning head operating surface.

2. The solution injection bar of claim 1 wherein the height dimension of the elongated upper cavity is further significantly greater than the depth dimension.

3. The solution injection bar of claim 1 wherein the cleaning solution flow restrictor further comprises a means for developing sufficient back pressure in the elongated upper cavity for effectively fluidly communicating liquid cleaning solution from the elongated upper cavity to the elongated lower solution discharge chamber in a substantially uniform flow along substantially an entire length of the elongated upper cavity between the spaced apart terminal end portions of the pair of cooperating plates.

4. The solution injection bar of claim 3 wherein the substantially rigid bar further comprises a pair of cooperating substantially rigid plates each comprising one of the pair of spaced apart outer walls with each of the outer walls terminating at substantially opposite ends in a pair of the spaced apart terminal end portions and one of the lengthwise upper edge portions extended between the terminal end portions and a substantially planar lengthwise lower edge surface spaced apart therefrom and extended between the terminal end portions and defining an elongated and substantially planar cleaning head operating surface, the pair of cooperating plates further comprising respective substantially planar mating interior faces formed between the respective outer walls thereof and arranged in a mating relationship and the elongated and substantially planar cleaning head operating surfaces being arranged in a substantially coplanar relationship;

wherein the elongated upper cavity formed interior of the bar further comprises an elongated cavity formed in the interior face of one or both of the pair of cooperating plates;

wherein the cleaning solution flow restrictor formed interior of the bar is further formed between the interior faces of the pair of cooperating plates; and wherein the elongated lower solution discharge chamber formed interior of the bar further comprises an elongated cavity formed in the interior face of one or both of the pair of cooperating plates with the elongated cleaning solution discharge slot being formed between the pair of cooperating plates.

5. The solution injection bar of claim 4 wherein the cleaning solution flow restrictor further comprises a pair of slightly spaced apart flow restrictor surfaces each formed in corresponding portions of the substantially planar interior faces of the pair of cooperating plates.

6. The solution injection bar of claim 4 wherein the cleaning solution flow restrictor further comprises an array of flow restriction orifices formed in a portion of the substantially planar interior face of one of the pair of cooperating plates in cooperation with an abutting surface portion of the substantially planar interior face of a different one of the pair of cooperating plates.

7. The solution injection bar of claim 4, further comprising a cleaning fluid retrieval slot adjacent to the cleaning head operating surface and substantially contiguous therewith.

8. A solution injection bar assembly, comprising:

an interconnected pair of cooperating substantially rigid elongated plates each defining an elongated outer wall terminating at substantially opposite ends in a pair of spaced apart terminal end portions and terminating along a lengthwise upper edge portion extended between the terminal end portions and further terminating along a substantially planar lengthwise lower edge surface extended between the terminal end portions and spaced apart from the lengthwise upper edge portion, the interconnected plates further comprising respective substantially planar mating interior faces formed between the respective outer walls thereof and arranged in a mating relationship;

a cleaning solution inlet orifice in fluid communication with the outer wall of one of the interconnected pair of plates or one of the terminal end portions thereof;

an elongated and substantially planar cleaning head operating surface formed by the respective substantially planar lengthwise lower edge surfaces of the interconnected plates arranged in a substantially coplanar relationship;

an elongated upper cavity formed between the mating interior faces of the interconnected plates adjacent to the lengthwise upper edge portions thereof and bounded on three sides by the lengthwise upper edge portion and spaced apart terminal end portions and defining an elongated upper solution distribution and pressure equalization chamber that is arranged in fluid communication with the solution inlet orifice for receiving there through a flow of pressurized liquid cleaning solution, the elongated upper cavity further comprising a substantially uniform length dimension, a substantially uniform height dimension and a substantially uniform depth dimension with the length dimension being significantly greater than both the height and depth dimensions;

an elongated lower solution discharge chamber formed between the mating interior faces of the interconnected plates adjacent to the substantially planar lengthwise lower edge surfaces thereof between the spaced apart terminal end portions of the plates and spaced away from the elongated upper cavity, the elongated lower solution discharge chamber being positioned for receiving the liquid cleaning solution from the elongated upper cavity;

an elongated cleaning solution discharge slot formed substantially contiguous with the elongated lower solution discharge chamber substantially opposite from the upper cavity and further being arranged in fluid communication with the cleaning head operating surface for delivering therethrough a substantially uniform pressurized flood of the received liquid cleaning solution thereto substantially continuously there along; and a cleaning solution flow restrictor formed between the mating interior faces of the interconnected plates, the cleaning solution flow restrictor being extended between the spaced apart terminal end portions of the respective plates and operatively arranged substantially contiguous with each of the elongated upper cavity and the elongated lower solution discharge chamber, whereby the elongated upper cavity is operatively arranged in fluid communication with the elongated lower solution discharge chamber along substantially the entire length thereof.

9. The assembly of claim 8 wherein the height dimension of elongated upper cavity is further significantly greater than the depth dimension thereof.

10. The assembly of claim 9 wherein the cleaning solution flow restrictor further comprises a means for developing sufficient back pressure in the elongated upper cavity for effectively fluidly communicating liquid cleaning solution from the elongated upper cavity to the elongated lower solution discharge chamber in a substantially uniform flow along substantially an entire length of the elongated upper cavity between the spaced apart terminal end portions of the pair of cooperating plates.

11. The assembly of claim 10 wherein the cleaning solution flow restrictor further comprises a pair of substantially uniformly spaced apart flow restrictor surfaces each formed in corresponding portions of the substantially planar interior faces of the respective interconnected plates.

12. The assembly of claim 10 wherein the cleaning solution flow restrictor further comprises a plurality of spaced apart flow restriction orifices in a portion of the substantially planar interior face of one of the interconnected pair of plates formed at intervals extended substantially contiguous with each of the elongated upper cavity and the elongated lower solution discharge chamber abutting a substantially planar surface portion of the substantially planar interior face of a different one of the interconnected pair of plates.

13. The assembly of claim 10, further comprising an elongated face plate coupled to each of the pair of cooperating elongated plates and spaced away therefrom and forming respective cleaning fluid retrieval slots therebetween adjacent to the cleaning head operating surface.

14. The assembly of claim 13, further comprising:

a substantially rigid tubular wand;

a cleaning head body attached to one end of the tubular wand, the cleaning head body retaining the solution injection bar assembly in a position relative to the tubular wand for applying the cleaning head operating surface thereof to a surface to be cleaned;

a vacuum chamber in fluid communication between the cleaning fluid retrieval slots and the tubular wand; and a cleaning solution delivery tube arranged in fluid communication with the cleaning solution inlet orifice for delivering there through a flow of pressurized liquid cleaning solution to the elongated upper cavity of the solution injection bar assembly.

15. A method of forming a solution injection bar assembly, the method comprising:

providing a plurality of cooperating substantially rigid elongated plates, each of the plates defining an elongated outer wall terminating at substantially opposite ends in a pair of spaced apart terminal end portions, a lengthwise upper edge portion that is extended between the terminal end portions, and a lengthwise lower terminal edge portion that is spaced apart from the lengthwise upper edge portion, and the lengthwise lower terminal edge portion of at least one or more of the elongated plates further comprising a substantially planar surface that is extended between the terminal end portions thereof;

forming a substantially planar cooperating interior face on each of the plates opposite from the respective outer wall thereof;

between the cooperating interior faces of the elongated plates forming an elongated upper cavity adjacent to the lengthwise upper edge portion thereof and bounded on three sides by the lengthwise upper edge portion and spaced apart terminal end portions of one or more of the plurality of cooperating plates and defining an elongated upper solution distribution and pressure equalization chamber, the elongated upper cavity further comprising a length dimension, a height dimension and a depth dimension with the length dimension being significantly greater than the height and depth dimensions;

forming a cleaning solution inlet orifice in the outer wall of one of the plates or one of the terminal end portions thereof, the cleaning solution inlet orifice being arranged in fluid communication with the elongated upper cavity for injecting thereinto a flow of pressurized liquid cleaning solution;

between the cooperating interior faces of the elongated plates forming a cleaning solution flow restrictor in a position substantially bounding the elongated upper cavity on a fourth side thereof opposite from the lengthwise upper edge portions of the plates and extended between the spaced apart terminal end portions substantially contiguous with the elongated upper cavity along substantially an entire length thereof;

between the cooperating interior faces of the elongated plates adjacent to the substantially planar lengthwise lower edge portions thereof and in fluid communication therewith, forming an elongated lower solution discharge chamber that is extended between the spaced apart terminal end portions of the plates substantially contiguous with the cleaning solution flow restrictor, the elongated lower solution discharge chamber being spaced away from the elongated upper cavity by the cleaning solution flow restrictor and in fluid communication therethrough with the elongated upper cavity; and interconnecting the plurality of elongated plates in a solution injection bar assembly with the substantially planar surfaces of the lengthwise lower terminal edge portions arranged in a substantially coplanar relationship and forming an elongated and substantially planar cleaning head operating surface that is extended between the terminal end portions of the plates, and with the cooperating interior faces of the plates arranged in a mating relationship and forming the elongated upper cavity in fluid communication with the elongated lower solution discharge chamber through the cleaning solution flow restrictor positioned substantially contiguously therebetween, and further with the elongated lower solution discharge chamber in substantially continuous fluid communication with the elongated and substantially planar cleaning head operating surface.

16. The method of claim 15, further comprising: between the cooperating interior faces of the elongated plates adjacent to the substantially planar lengthwise lower edge portions thereof and substantially contiguous with the elongated lower solution discharge chamber, forming an elongated cleaning solution discharge slot in substantially continuous fluid communication between the elongated lower solution discharge chamber and the cleaning head operating surface with the elongated cleaning solution discharge slot being arranged with the cleaning head operating surface for delivering therethrough a substantially uniform pressurized flood of the received liquid cleaning solution thereto substantially continuously there along.

17. The method of claim 16 wherein: the providing a plurality of cooperating substantially rigid elongated plates further comprises providing a middle one of the plurality of elongated plates and a pair of outside ones thereof, the middle elongated plate further defining opposing ones of the cooperating interior faces on opposite sides thereof, and the outside elongated plates each further comprising the lengthwise lower terminal edge portion comprising the substantially planar surface that is extended between the terminal end portions thereof;

the forming the elongated upper cavity and the elongated lower solution discharge chamber further comprises forming the elongated upper cavity and the elongated lower solution discharge chamber in the middle elongated plate; and the interconnecting the plurality of elongated plates in a solution injection bar assembly further comprises interconnecting the outside elongated plates on opposite sides of the middle elongated plate with their respective interior faces each adjacent to one of the cooperating interior faces thereof, and the substantially planar surfaces of the lengthwise lower terminal edge portions of the pair of outside elongated plate being arranged in the substantially coplanar relationship and forming the elongated and substantially planar cleaning head operating surface that is extended between the terminal end portions of the plates.

18. The method of claim 16 wherein: the providing a plurality of cooperating substantially rigid elongated plates further comprises providing a pair of the elongated plates each defining one of the elongated outer walls terminating at substantially opposite ends in a pair of spaced apart terminal end portions, the lengthwise upper edge portion that is extended between the terminal end portions, and the lengthwise lower terminal edge portion that is spaced apart from the lengthwise upper edge portion, and wherein the lengthwise lower terminal edge portion of each of the pair of elongated plates further comprising a substantially planar surface that is extended between the terminal end portions thereof;

the forming the elongated upper cavity comprises forming the elongated upper cavity in at least one of the elongated plates;

the forming the elongated lower solution discharge chamber further comprises forming the elongated lower solution discharge chamber in at least one of the elongated plates; and the interconnecting the plurality of elongated plates in a solution injection bar assembly further comprises interconnecting the pair of elongated plates with their respective interior faces in an adjacent relationship, and the substantially planar surfaces of the lengthwise lower terminal edge portions of the pair of elongated plates being arranged in the substantially coplanar relationship and forming the elongated and substantially planar cleaning head operating surface that is extended between the terminal end portions of the plates.

19. The method of claim 18 wherein the forming a cleaning solution flow restrictor further comprises: in the interior face of at least one of the pair of elongated plates forming an array of notches extended between the spaced apart terminal end portions of the plate between the elongated upper cavity and the elongated lower solution discharge chamber; and in the interior face of a different one of the pair of elongated plates forming a cooperating portion extended between the spaced apart terminal end portions of the plate.

20. The method of claim 19 wherein the forming a cooperating portion in the interior face of a different one of the pair of elongated plates further comprises forming a portion between the elongated upper cavity and the elongated lower solution discharge chamber and substantially flush with the interior face of the plate and extended between the spaced apart terminal end portions of the plate.

21. The method of claim 19, further comprising forming a substantially rigid cleaning solution extraction slot adjacent to an exterior face of at least one of the pair of elongated plates.

* * * * *